US005383007A

United States Patent [19]

Kinoshita et al.

[11] Patent Number: 5,383,007

[45] Date of Patent: Jan. 17, 1995

[54] APPARATUS FOR MEASURING DEVELOPER DENSITY BY REFLECTED LIGHT FROM THE DEVELOPER ILLUMINATED THROUGH A DETECTION WINDOW

[75] Inventors: Naoyoshi Kinoshita, Hoi; Kouichi Etou, Toyokawa, both of Japan

[73] Assignee: Minolta Camera Kabushiki Kaisha, Osaka, Japan

[21] Appl. No.: 822,635

[22] Filed: Jan. 17, 1992

Related U.S. Application Data

[63] Continuation-in-part of Ser. No. 699,948, May 14, 1991.

[51] Int. Cl.[6] ..... G03G 21/00

[52] U.S. Cl. ..... 355/246; 355/208; 355/245

[58] Field of Search ..... 355/246, 245, 203, 260, 355/208, 251, 253, 204; 118/691; 366/241, 244, 279, 309

[56] References Cited

U.S. PATENT DOCUMENTS

| | | | |
|---|---|---|---|
| 4,043,293 | 8/1977 | Ruckdeschel | 118/691 |
| 4,266,141 | 5/1981 | Hirakura et al. | 118/691 X |
| 4,451,135 | 5/1984 | Okumura | 118/691 X |
| 4,550,998 | 11/1985 | Nishikawa | 355/203 X |
| 4,551,002 | 11/1985 | Aoki et al. | 118/691 X |
| 4,883,019 | 11/1989 | Menjo et al. | 118/691 |
| 4,936,249 | 6/1990 | Tajima et al. | 355/251 X |
| 4,980,727 | 12/1990 | Stelter | 355/246 |

FOREIGN PATENT DOCUMENTS

| | | | |
|---|---|---|---|
| 0232375 | 12/1984 | Japan | 355/246 |
| 60-80879 | 5/1985 | Japan . | |
| 60-159872 | 8/1985 | Japan . | |
| 60-220374 | 11/1985 | Japan . | |
| 61-212868 | 9/1986 | Japan . | |
| 63-177173 | 7/1988 | Japan . | |
| 0178276 | 7/1988 | Japan | 355/246 |
| 0208075 | 8/1988 | Japan | 355/246 |
| 0105973 | 4/1989 | Japan | 355/246 |

*Primary Examiner*—A. T. Grimley
*Assistant Examiner*—Sandra L. Brasé
*Attorney, Agent, or Firm*—Willian Brinks Hofer Gilson & Lione

[57] ABSTRACT

Apparatus for measuring developer density comprising, a developer agitator section agitating a developer, a rotational conveying member conveying the developer in the developer agitator section with its rotation, a transparent detection window facing the developer agitator section, a plurality of magnets being fixed on the rotational conveying member, and retaining the developer, and causing the developer to be brought into contact with the transparent detection window with a rotation of the rotational conveying member, a density detection section measuring the developer density on the basis of reflected light by illuminating the developer retained on the magnets, and caused to be brought into contact with the detection window, and the magnets including at least one cleaning magnet, and the density detection section is situated in a passage of the developer which is conveyed so as to be circulated through first agitator passage adjacent to a development section and second agitator passage behind the first agitator passage, and between a passage for conveying the developer from the first agitator passage to the second agitator passage and a replenishment opening for replenishing the toner to the second agitator passage.

33 Claims, 20 Drawing Sheets

APPARATUS FOR MEASURING DEVELOPER DENSITY BY REFLECTED LIGHT FROM THE DEVELOPER ILLUMINATED THROUGH A DETECTION WINDOW

FIELD OF THE INVENTION

This is a continuation-in-part application of our copending application Ser. No. 7/699,948 filed on May 14, 1991.

The present invention relates to an apparatus for measuring developer density by using an optical means in a development apparatus in which a powder developer constituted by a toner and a carrier is contained.

BACKGROUND OF THE INVENTION

Conventionally, in an image forming device which uses a powder developer constituted by a toner and a carrier, measurement of developer density, namely, weight mixture ratio of the toner to the carrier (hereinafter, referred to as "toner density"), has been performed, in order to keep density of an image properly.

The measuring technique for the toner density is roughly classified into two methods.

In a first method, permeability of the developer is measured by a magnetic sensor which is provided on a developed agitator in a development apparatus, and the toner density is derived from a measured value (hereinafter, this method is referred to as "magnetic measurement method").

In a second method, the toner density in the developer is measured from quantity of reflected light from the developer which is illuminated through a transparent detection window (hereinafter, this method is referred to as "optical measurement method").

When the magnetic measurement method and the optical measurement method are compared with each other, the optical measurement method has advantages that the toner density can be measured more directly, and the measurement becomes more insensible to variation of the developer caused by variation of an environment and variation of bulk density in the optical measurement method than in the magnetic measurement method. For example, in the optical measurement method, an error in the measurement is not caused even if a condition of humidity varies. On the other hand, the optical measurement method has a drawback that an error in the measurement is caused by adhesion of the developer onto the detection window.

In order to eliminate the drawback of the known optical measurement method, other optical measurement methods (1) and (2) are proposed. In the method (1), the toner density is measured by illuminating the magnetic brush of the developer retained on a rotary sleeve in a development section and the magnetic brush is brought into contact with the transparent detection window so as to clean the detection window. In the method (2), the toner density is measured by illuminating the developer contained in the developer agitator and a magnet is provided on a rotary agitator member of the developer agitator such that the detection window is cleaned by the developer adhering to the magnet.

However, according to the method (1), the sleeve must be rotated in order to measure the toner density. If the sleeve is rotated during non-development period, powder smoke and toner falling from the sleeve occur, and such an undesirable situation may occur that the interior of the development apparatus is contaminated.

Therefore, in a device for forming a multi-color image which is provided with a plurality of development apparatuses containing respectively a developer of a different color, and forming an image by bringing each development apparatus alternatively one by one into contact with a photosensitive drum, the above method (1) should not be adopted, because if the toner density in the development apparatuses which are remote from the photosensitive drum are measured by the above method (1), not only the interiors of the apparatuses are contaminated by the powder smoke and the falling toner, but also the image may be adversely affected. Especially, in the device in which the development apparatuses are arranged one on the other in a row, if the toner falling down from upward adheres to the sleeve of the development apparatus which is developing, or to the photosensitive drum, the image may be adversely affected seriously. Due to these circumstances, it is impossible to adjust the toner density in advance when the development apparatuses are remote from the photosensitive drum so as to develop in no time when each development apparatus faces the photosensitive drum. Further, due to these restrictions, it takes a long period of time to complete a full-color image, resulting in obstacle to realization of high speed device.

On the other hand, in the above method (2), since a flow of the developer, and consequently a level of the surface varies with the rotation of the developer agitator member, this method has drawbacks that amount of the developer does not be stabilized, and correct toner density can not be measured.

Further, if amount or bulk density of the developer, which is in contact with the detection window, varies, a result of measurement varies with it. In other words, there is a drawback that the result may indicate the developer density is improper, even developer density is proper.

SUMMARY OF THE INVENTION

Accordingly, an essential object of the present invention is to provide an apparatus for measuring developer density, by using an optical means in a developing apparatus, which eliminate the above described disadvantages inherent in the conventional apparatuses.

In accomplishing these and other objects, according to one preferred embodiment of the invention, there is provided an apparatus for measuring developer density comprising, a developer agitator section agitating a developer, a rotational conveying member conveying the developer in the developer agitator section with its rotation, a transparent detection window facing the developer agitator section, a plurality of magnets being fixed on the rotational conveying member, and retaining the developer, and causing the developer to be brought into contact with the transparent detection window with a rotation of the rotational conveying member, a density detection section measuring the developer density on the basis of reflected light by illuminating the developer retained on the magnets, and caused to be brought into contact with the detection window, and the magnets including at least one cleaning magnet, and the density detection section is situated in a passage of the developer which is conveyed so as to be circulated through first agitator passage adjacent to a development section and second agitator passage behind the first agitator passage, and between a passage for conveying the developer from the first agitator passage to the second agitator passage and a replenishment opening for replenishing the toner to the second agitator passage.

By the above described apparatus for measuring developer density, the developer retained on the magnets is rubbed against the detection window so as to remove the developer adhering onto the detection window. Therefore, the detection window is cleaned, so that the developer density is measured under a condition in which the developer does not adhere on the detection window.

Further, real developer density is measured based on the developer retained by magnetic force of a magnet, and existing in a space having a constant width between the magnets and the detection window.

Namely, the toner density is measured based on the quantity of the reflected light from the illuminated developer having always constant thickness.

BRIEF DESCRIPTION OF THE DRAWINGS

These and other objects and features of the present invention will become clear from the following description taken in conjunction with the preferred embodiments thereof with reference to the accompanying drawings, in which:

FIG. 10 is a flow-chart of a main routine, and FIGS. 11 to 22 are flow-charts concerning with processes to measure the developer density;

DETAILED DESCRIPTION OF THE INVENTION

Figure 1:
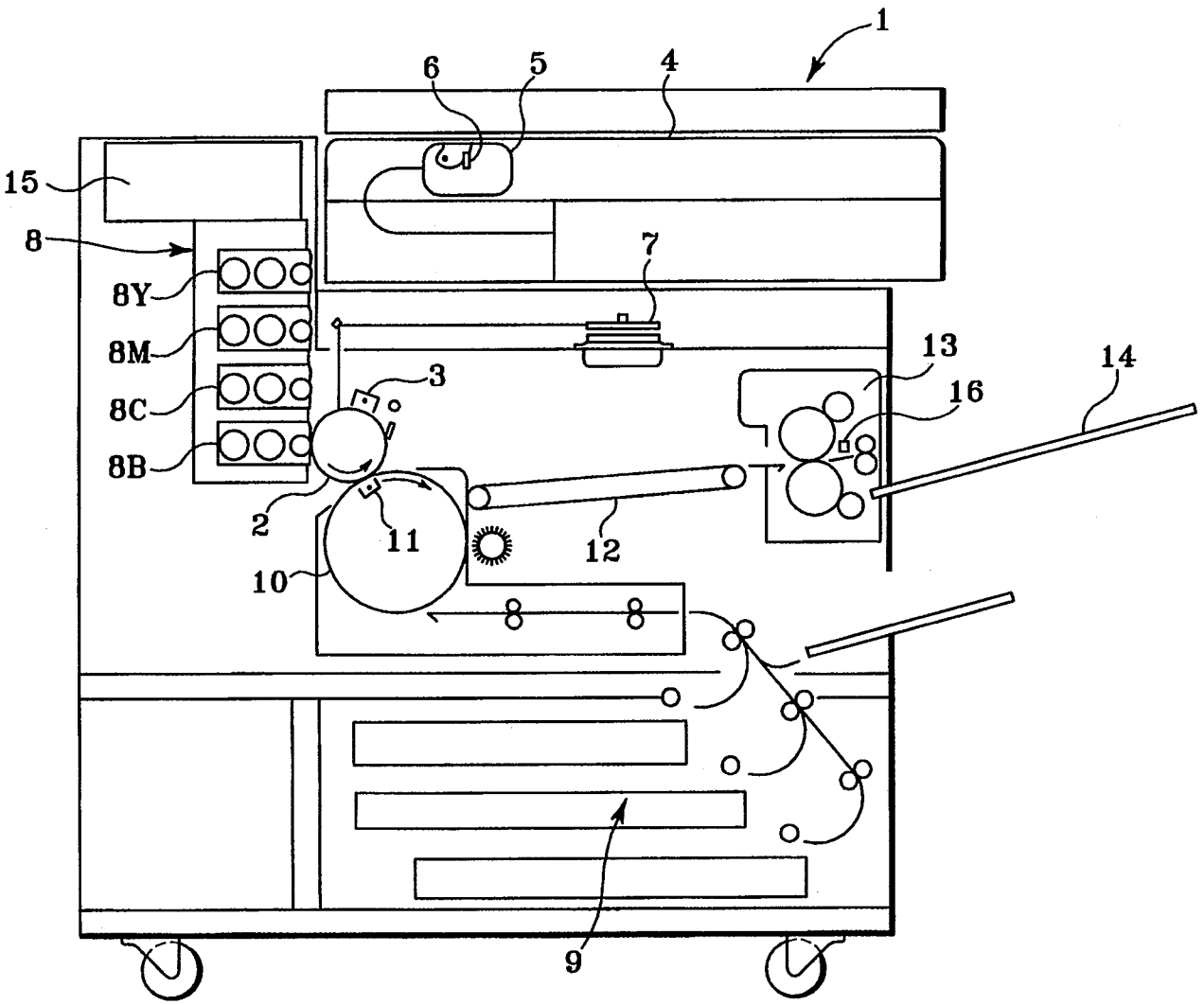
FIG. 1 is a sechematic sectional view of a full-color copying machine including an apparatus for measuring developer density, according to the present invention.

Before the description of the present invention proceeds, it is to be noted that like parts are designated by like reference numerals throughout the accompanying drawings.

I. Copying Machine

Referring now to the drawings, there is shown in FIG. 1 a full-color copying machine 1 using a electrophotographic method, according to one preferred first embodiment of the present invention. In this copying machine 1, upon depression of a printswitch 100 (See, FIG. 7), a photosensitive drum 2 rotates in the direction of an arrow, in addition a photosensitive layer of the photosensitive drum 2 is uniformly and electrically charged by a charging device 3.

An image reader 5 illuminates an original document (not shown) placed on an original document platform 4, and reflected light from the original document is incident on an optical reader 6 in which pixels of an image of the original document are read as color signals of red, blue and green. These color signals of red, blue and green are converted into binary image signals corresponding to each of a yellow color image, a magenta color image, a cyan color image, or in addition to these, a black color image of the document by an image processing circuit, and each image signal is input to a laser generator 7.

The laser generator 7 illuminates the electrically charged region of the photosensitive drum 2 by a laser beam which is modulated on the basis of the image signals, and forms an electrostatic latent image there corresponding to an image information of each color.

A development unit 8 is provided with a plurality of development apparatuses 8Y, 8M, 8C, 8B. Each of these apparatuses contains a two-component developer constituted by a toner and a carrier, and moves up and down as a whole, so that a selected one of the development apparatuses facing the photosensitive drum 1 visualizes the electrostatic latent image as a toner image of a corresponding color. The above development apparatuses 8Y, 8M, 8C, 8B contain, respectively, a toner of yellow(Y), magenta(M), cyan(C) or black(B) color.

The toner image of each color is transferred successively to a transfer paper fed from a paper feeder 9, and wound around a transfer drum 10 by a transfer apparatus 11, and thus a full-color toner image is formed.

The transfer paper, on which the full-color toner image is formed, is separated from the transfer drum 10, and transported to a fixing apparatus 13 by a transportation apparatus 12, thereafter the toner image is fixed onto the transfer paper by heating, and the transfer paper is discharged into a discharge tray 14.

II. Development Apparatus

Figure 2:
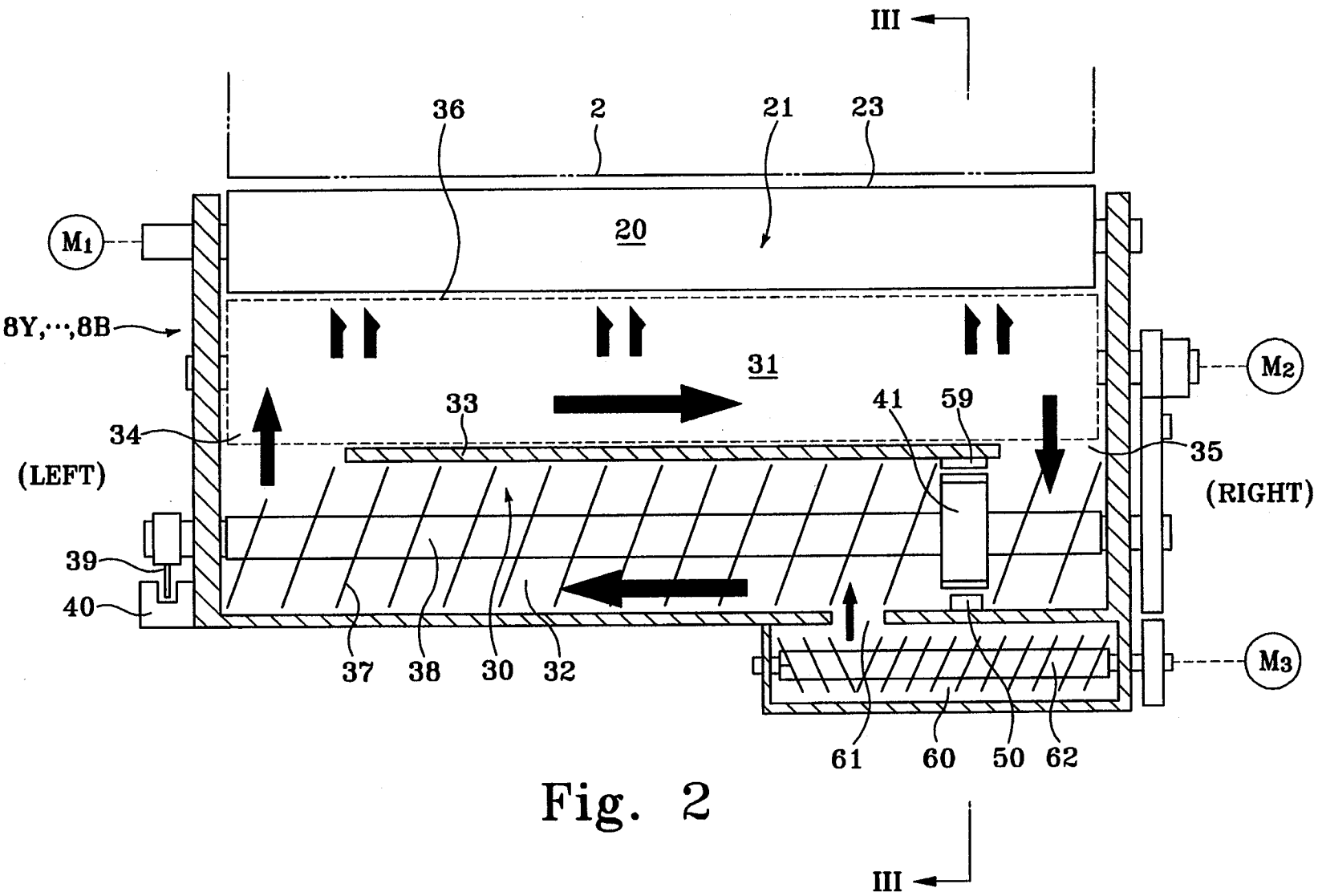
FIG. 2 is a transverse sectional view of a development apparatus showing a first embodiment of the invention.
Figure 3:
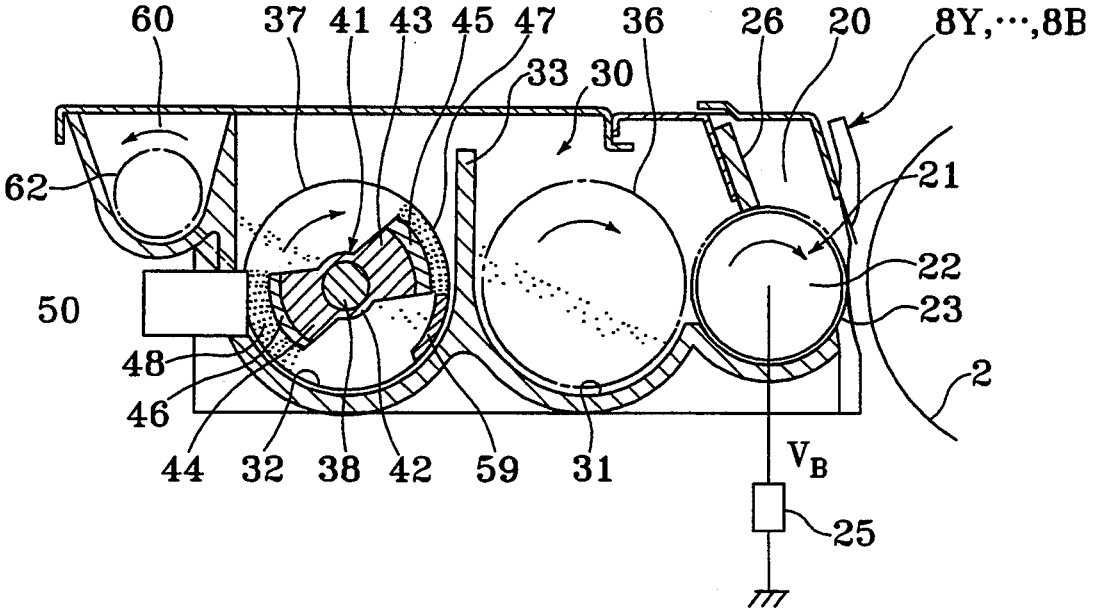
FIG. 3 is a sectional view taken along the line III—III of FIG. 2.

FIGS. 2 and 3 each show structure of the development apparatuses 8Y, 8M, 8C, 8B.

Since the development apparatuses 8Y, 8M, 8C, 8B have an identical structure, only the development apparatus 8Y is described as for common structure for the sake of brevity, hereinafter.

The development apparatus 8Y is constituted roughly by a development section 20, a developer agitator section 30(hereinafter, referred to as "agitator section 30") and a toner replenishment section 60.

(i) Development Section 20

In the development section 20, a development roller 21 situated facing the photosensitive drum 2 is disposed. The development roller 21 is comprised with a magnet body 22 fixed non-rotatably, and a sleeve 23 is coupled to a development motor M1 such that the sleeve 23 is driven to rotate in a direction of an arrow. The sleeve 23 is connected with high voltage electric power source 25, so that a predetermined development bias $V_B$ is applied to the sleeve 23. Further, a blade 26 for adjusting a height of magnetic bristles is disposed so as to face an upper peripheral surface of the sleeve 23.

(ii) Agitator Section 30

In the agitator section 30, first agitator passage 31 and second agitator passage 32 are formed. The first agitator passage 31 is adjacent to the development section 20, and behind it a second agitator passage 32 is situated. While these first and second agitator passages 31, 32 are separated from each other by a wall 33, they are communicated with each other by respective passages 34, 35 formed by cutting off at opposite end portions of the wall 33.

A bucket roller 36 and a conveying screw 37 are disposed in the first agitator passage 31, the second agitator passage 31 respectively. Further, both of them are coupled to a agitator motor M2 such that they are driven to rotate in a direction of an arrow.

A detection plate 39 is provided on a portion of a shaft 38 of the conveying screw 37 which is projected from a developer tank, and rotates with the conveying screw 37 so as to be detected by a photo-interrupter 40. Rotated positions of magnets 45, 46 are detected by this photo-interrupter 40, as described below.

A magnet retainer 41 is made of a non-magnetic material, and is constituted by a cylindrical main body 42 and two sectorial projections 43, 44 projecting in opposite directions each other from the main body 42. On outer surfaces of these projections 43, 44, magnets 45, 46 are disposed. A distance from a center of the main body 42 to an outer surface of the magnet 45 is longer than that of the magnet 46. Hereinafter, the magnet 45 is referred to as cleaning magnet 45, and the magnet 46 is referred to as density measurement magnet 46.

The main body 42 is fitted around the shaft 38 such that the magnet retainer 41 of the above mentioned arrangement is fixed in the vicinity of the right-hand passage 35 in FIG. 2.

Figure 4:
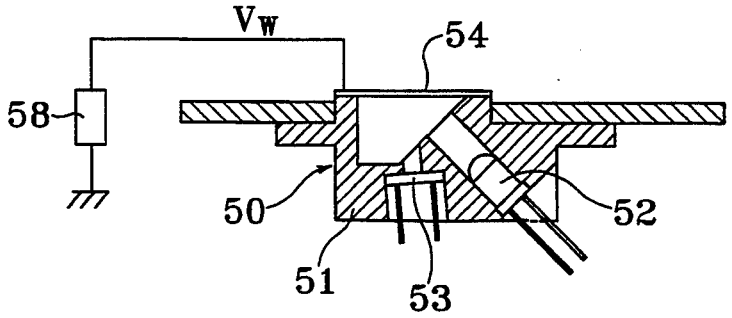
FIG. 4 is a sectional view of a sensor for toner density detection used in the present invention.

A sensor 50 for the toner density detection, as shown in FIG. 4 is constituted by a housing 51, a light emitting element 52 and a light receiving element 53 which are fixed to the housing 51, and a transparent detection window 54 covering detection positions of these elements 52, 53.

Figure 5:
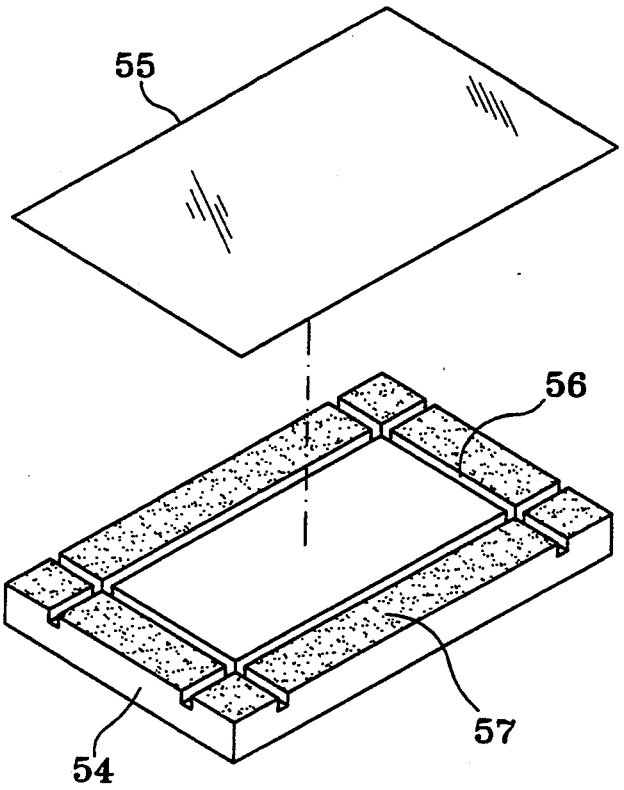
FIG. 5 is a perspective view of a detection window and electrically conductive film used in the present invention.

On an outer surface of the detection window 54, as shown in FIG. 5, a transparent and electrically conductive film (e.g., electrically conductive glass) 55, which is connected with a electric power source 58 for window bias, is bonded such that window bias $V_W$ is applied to the film 55.

The window bias $V_W$ has a polarity identical with that of a charged toner such that adhesion of the toner to the film 55 is prevented by repulsive action between electric charge of the charged toner and the window bias $V_W$.

Meanwhile, in the case that the development bias $V_B$ applied to the sleeve 23 has a polarity identical with a polarity of the charged toner, the electric power source 58 may act also as the electric power source 25 for the development bias, and thus the circuit configuration can be simplified.

As shown in FIG. 5, slots 56 are formed along with four sides of the detection window 54. At outside of the slots 56, an adhesive 57 is applied, and the film 55 is stuck on it. By this way, it is prevented by the slots 56 that the adhesive 57 invades the interior of the slots 56 by capillarity, and thus the detection window 54 is not contaminated.

Further, it is preferable that the detection window 54 is made of material which has a tendency to be charged to a polarity identical with that of the charged toner. As its materials, examples of the material having a tendency to be charged to positive polarity are glass, acrylic resin, acetate resin, while examples of the material having a tendency to be charged to negative polarity are fluorine-contained resin; e.g., PFA etc., polyvinylchloride resin, polyether sulphone etc.

As shown in the FIGS. 2 and 3, the above sensor 50 is mounted on and passed through a rear wall portion of the second agitator passage 32 facing the region, in which the above magnets 45, 46 pass, and the transparent detection window 54 is situated so as to face the magnets 45, 46.

A scraper 59 is made of non-magnetic plastic, rubber or plastic-film etc., and is disposed in a portion of the second agitator passage 32 facing the region in which the magnets 45, 46 pass, and minute gap is maintained between the front surface of the scraper 59 and the cleaning magnet 45.

(iii) Toner Replenishment Section 60

The toner replenishment section 60 is adjacent to a rear portion of the second agitator passage 32, and is communicated with the second agitator passage 32 through a replenishment opening 61 which is formed right-hand in FIG. 2 of the sensor 50. Further, in the toner replenishment section 60, a replenishment screw 62, which is coupled to a toner replenishment motor M3, is disposed such that the screw 62 is rotated by the motor M3. Further, the toner replenishment section 60 is coupled to a toner hopper 15 (See FIG. 1) such that a toner of a corresponding color is replenished to the section 60 from this toner hopper 15.

(iv) Sensor Circuit Section

Figure 6:
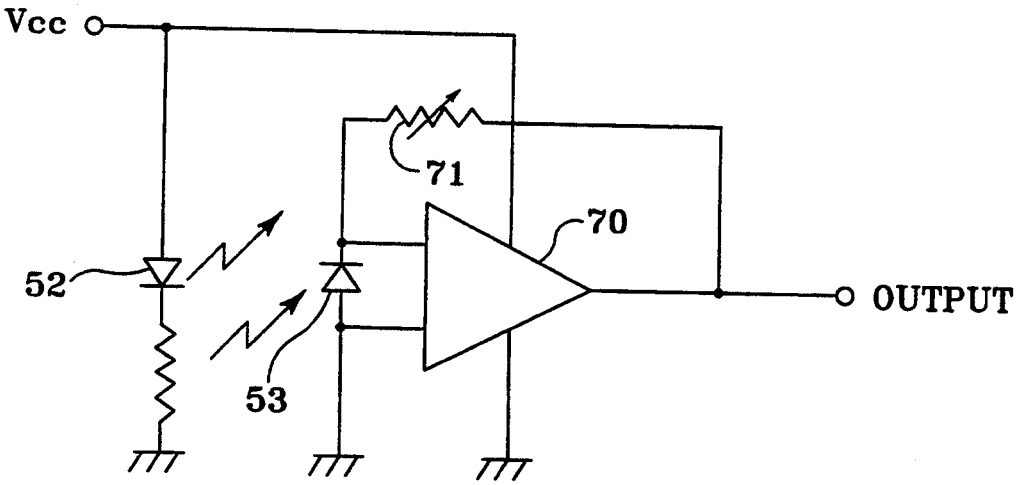
FIG. 6 is a circuit diagram of the sensor used in the present invention.

FIG. 6 shows a constitution of a circuit of the sensor 50. In FIG. 6, reference numeral 70 designates an operational amplifier, and reference numeral 71 designates a gain adjuster, which converts electric current flowing in a light receiving element 53 into voltage, so that an output from this element is input to an analog input port of a CPU shown in FIG. 7. Meanwhile, the light emitting element 52 emits a light having a peak value at a wave-length of 890 nm, and the light receiving element 53 sensitive to the light of the above wave-length is used.

(v) Main Controller Circuit Section

Figure 7:
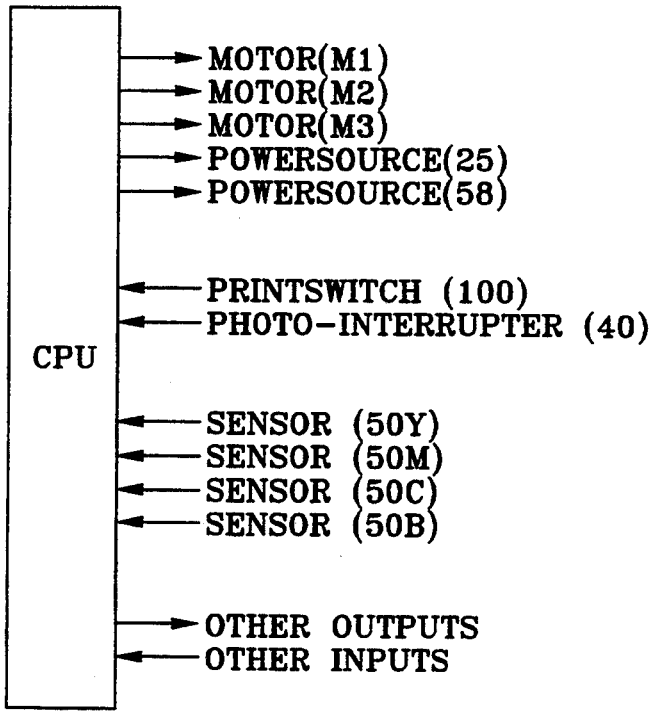
FIG. 7 is a block diagram of a CPU used in the present invention.

FIG. 7 is a block diagram of a controller circuit showing the main controller circuit section, from which remote signals are output to the development motor M1, the agitator motor M2, the toner replenishment motor M3, the electric power source 25, and the electric power source 58, respectively and to which signals output from sensors 50Y, 50M, 50C, 50B are input. The above references 50Y, 50M, 50C, 50B show, respectively, the sensors for the toner density detection provided in each of the development apparatuses 8Y, 8M, 8C, 8B.

III. Development Operation Of Each Development Apparatus (i) Development operation of each development apparatus is described hereinafter.

In the development apparatus, a developer constituted by a toner and a carrier is contained in the first agitator passage 31 and the second agitator passage 32, the developer in the first agitator 31 is conveyed in the right-ward direction in FIG. 2 with the rotation of the bucket roller 36, and conveyed into the second agitator passage 32 through the right-hand passage 35.

The developer in the second agitator passage 32 is conveyed in the left-ward direction in FIG. 2 with the rotation of the conveying screw 37, and conveyed into the first agitator passage 31 through the left-hand passage 34.

In this way, the developer in the agitator section 30 is circulated through the passages 34, 35, and mixed and agitated during the circulation, thereby the toner and the carrier are charged to opposite polarity each other.

Further, the developer is supplied to the outer surface of the sleeve 23 by the bucket roller 36 when the developer is conveyed in the first agitator passage 31. The developer supplied to the sleeve 23 is retained by magnetic force of the magnet body 22, and is conveyed in the direction of an arrow with the rotation of the sleeve 23, and a height of magnetic bristles of the developer is adjusted by the blade 26, thereafter the development is performed by supplying the toner to the electrostatic latent image on the portion of the electrosensitive drum 2 facing to the sleeve 23. And thus, the electrostatic latent image is visualized.

In the second agitator passage 32, the developer is retained on the magnets 45, 46 rotating with the conveying screw 37, and conveyed in the direction of an arrow.

The developers retained on the magnets 45,46 form magnetic brushes 47, 48, and the magnetic brush 47 retained on the cleaning magnet 45 and the magnetic brush 48 retained on the density measurement magnet 46 are rubbed against the detection window 54 of the sensor 50 with a rotation of the conveying screw 37. Further, the magnetic brushes 47, 48 are scraped off by the scraper 59 after they are rubbed against the detection window 54, thereafter new developer is retained on the magnets 45, 46. The toner density is measured succeedingly from this new developer which is conveyed in left-ward direction in a second agitator passage 32.

Furthermore, the developer adhering onto the detection window 54 is removed when the magnetic brush 47 on the cleaning magnet 45 comes into contact with the detection window 54.

In the sensor 50, light emitted from the light emitting element 52 illuminates the developer through the detection window 54, and reflected light from the developer is detected by the light receiving element 53, and a signal of voltage corresponding to quantity of receiving light is output to the CPU from the light receiving element 53.

Meanwhile, when the density measurement magnet 46 faces the sensor 50, there exists a developer of substantially constant amount between the density measurement magnet 46 and the sensor 50 by magnetic force of the magnet 46. Accordingly, although the output from the sensor 50 varies with the value of the toner density, the output does not vary with a variation of the amount of the developer contained in the second agitator passage 32.

On the other hand, when the magnets 45, 46 do not face the sensor 50, the output from the sensor 50 varies with the variation of the amount of the developer.

Figure 9:
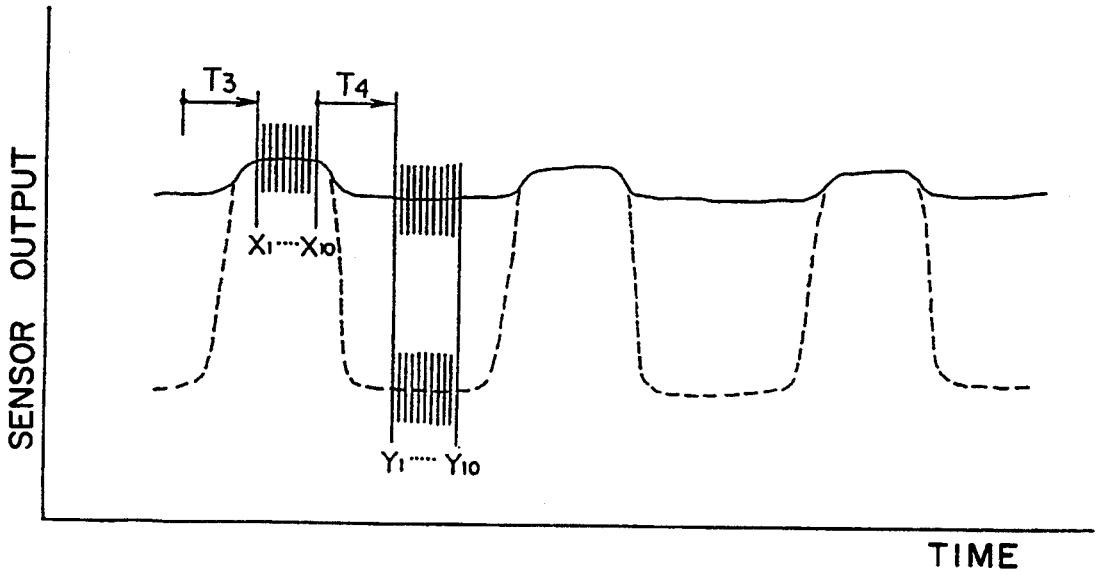
FIG. 9 shown an output from the sensors used in the present invention.
Figure 10:
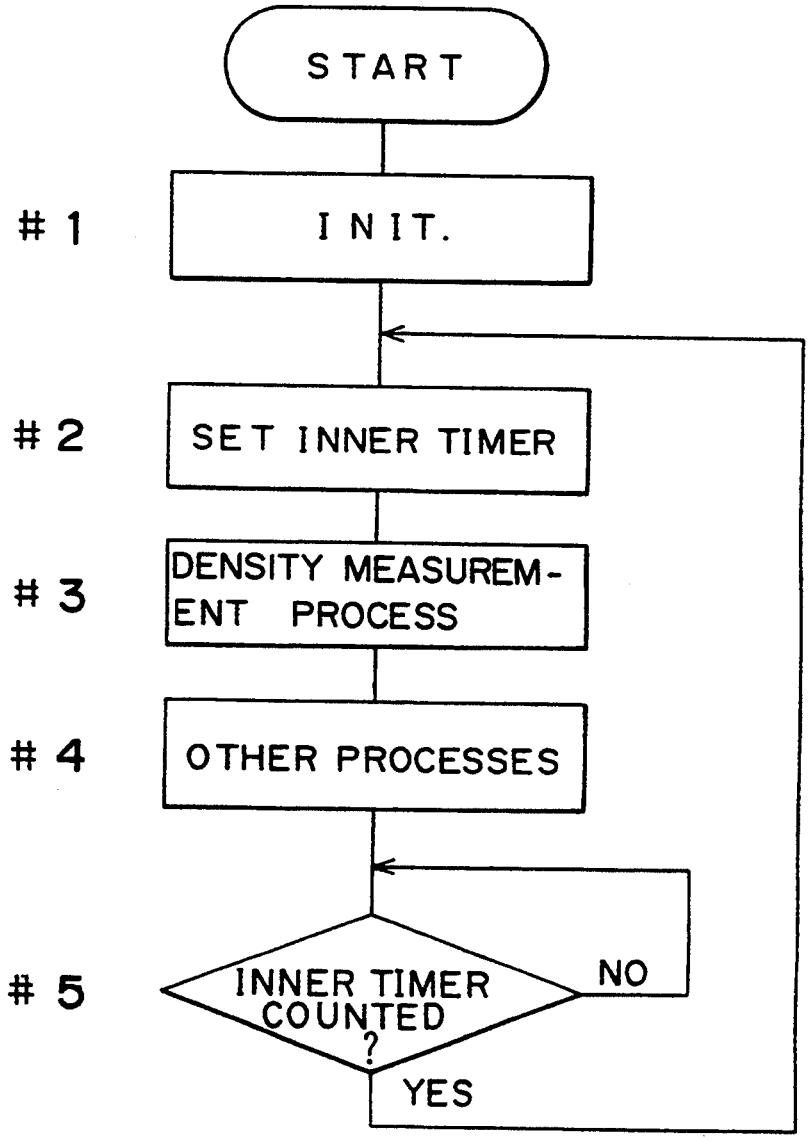
FIGS. 10 to 22 are flow-charts of control for measuring the developer density by the apparatus according to the present invention.
Figure 11:
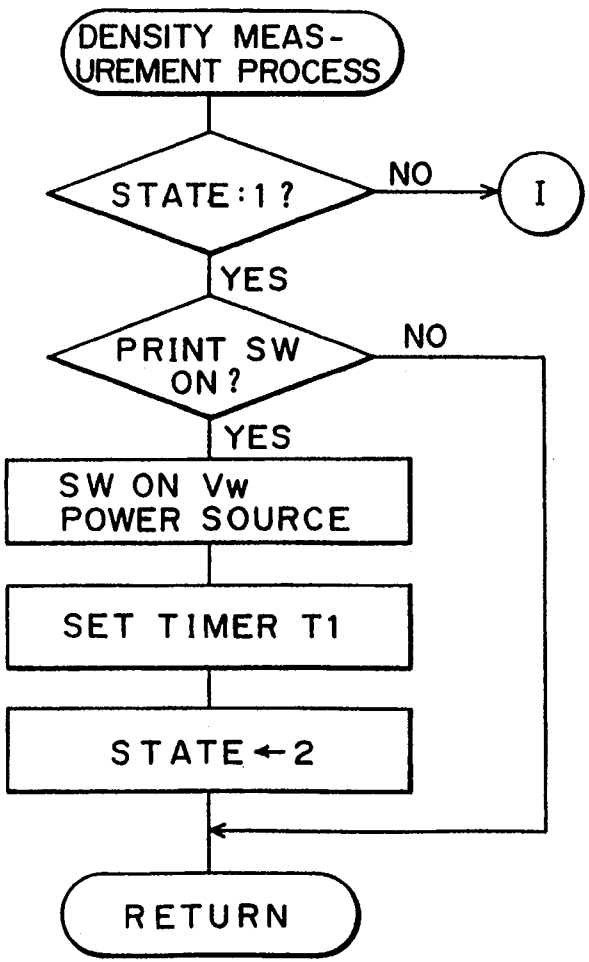

On the basis of these points, when the magnetic brush 48 of the density measurement magnet 46 is rubbed against the detection window 54, the toner density is measured from a signal output from the light receiving element 53 (i.e., a signal at a maximum peak portion in FIG. 9).

Further, when the magnetic brushes 47, 48 are not in contact with the detection window 54, the amount of the developer is measured from a signal output from the light emitting element 53 (i.e., a signal at a minimum peak portion in FIG. 9).

It is to be noted that the measurement of the toner density and the measurement of the amount of the developer are performed not only in the development apparatus facing to the photosensitive drum 2, but also in the development apparatuses not facing to the photosensitive drum 2.

Namely, in the development apparatus in a state of non-development, the toner density and the amount of the developer are measured by suitably driving the agitator motor M2, and thus, when the development apparatus is brought into a state of development, the toner density and the amount of the developer have been already adjusted properly.

(ii) Referring to flow charts shown in FIGS. 10 to 22, control executed by the CPU concerning with processes for the toner density measurement and processes for the measurement of the amount of the developer, etc. are described in detail hereinafter.

a. Main Routine (See, FIG. 10)

In a main routine, when a program starts by switching on the copying machine 1 so as to connect it with an electric power source, at step #1, registers and peripheral interfaces are initialized.

At step #2, an inner timer for determining a time interval, of one routine is started. This time interval of one routine acts as a reference for time counting in various timers to be described below. A count number of each timer under controlling operation among the above various timers is updated per program flow passing through the main routine.

At step #3, a process of the toner density measurement to control density of an image is executed. This process is described below in detail.

At step #4, processes required for other development operations are executed.

At step #5, it is judged whether or not the counting executed by the inner timer has finished, and this judgement is repeated in the case of "NO", while in the case of "YES", step #2 follows.

By the above processes, the length of a period of one routine is kept constant, each process of steps #2 to #5 is repeated during the copying machine 1 is switched on.

b. Process For The Toner Density Measurement (1) In the process shown in FIG. 11, at step #11, it is judged whether or not a state number is "1". It is determined by this state number which kind of process should be executed, and this state number is set to "1" at the initial setting process (step #1).

As a consequence of this judgment in the case of "NO", step #21 follows, while in the case of "YES", step #12 follows. At step #12, it is judged whether or not the print switch 100 is depressed, and is ON edge is detected, and in the case of "NO", the program flow returns to the main routine.

On the other hand, in the case of "YES" at step #12, step #13 follows.

Figure 8:
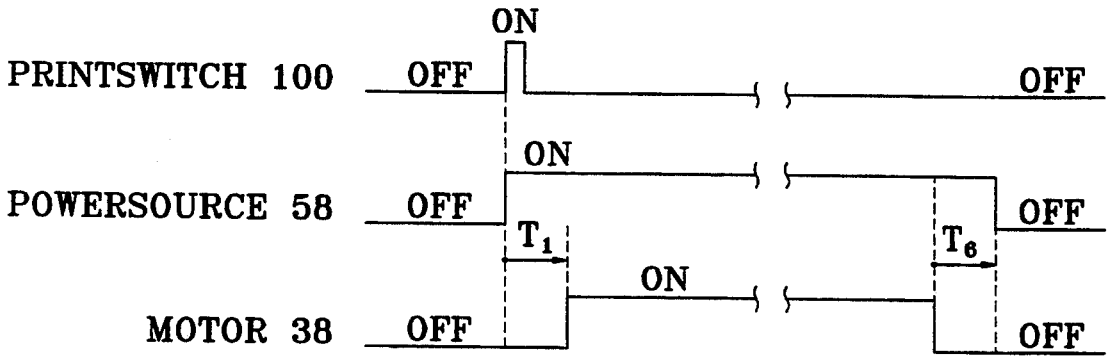
FIG. 8 is a time chart showing an operational timing of an electric power source for window bias and an agitating motor used in the present invention.

At step #13, the electric power source 58 is switched on, so as to apply a voltage of a polarity identical with that of the charged toner to the electrically conductive film 55 of the detection window 54 (See FIG. 8). Next, at step #14, a timer T1 for securing rise of the window bias is set. At step #15, the state number is set to "2", thereafter the program flow returns to the main routine.

The above timer T1 is provided to ensure that the window bias $V_W$ is applied to the electrically conductive film 55 covering the detection window 54 before the agitator motor M2 is driven. Such a process is executed because if the conveying screw 37 begins to rotate by driving the agitator motor M2 before the window bias $V_W$ is applied to the film 55, the developer agitated with the rotation adheres onto the film 55, and the developer adhering onto the window before the appliance is difficult to be removed from the surface of the detection window 54 even if the window bias $V_W$ is applied to the window later.

Figure 12:
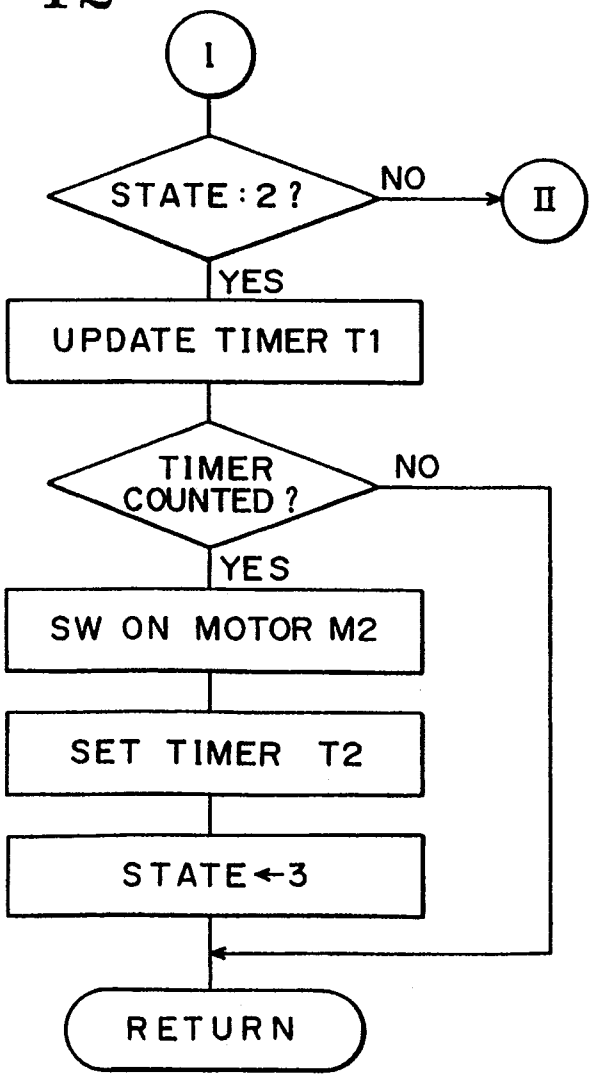

(2) In a process shown in FIG. 12, it is judged whether or not the state number is "2" at step #21, and in the case of "NO", step #31 follows, while in the case of "YES", step #22 follows.

At step #22, a count number in the timer T1 is updated. Next, at step #23, it is judged on the basis of to the count number whether or not the counting in the timer T1 has finished, and in the case of "NO", the program flow returns to the main routine, while in the case of "YES", step #24 follows, and the agitator motor M2 is driven (See, FIG. 8).

Next, at step #25, a timer T2 for securing rise of a rotating speed of the agitator motor M2 is set. At step #26, the state number is set to "3", thereafter the program flow returns to the main routine.

A time period set in the above timer T2 is equal to a time period required to stabilize the rotation of the agitator motor M2 after a voltage is applied to this motor, and is longer than a time period required to stabilize a flow of the developer. Since, during this time set in the timer T2, an output from the sensor 50 is not stabilized yet, a detection based on the output is not executed.

Figure 13:
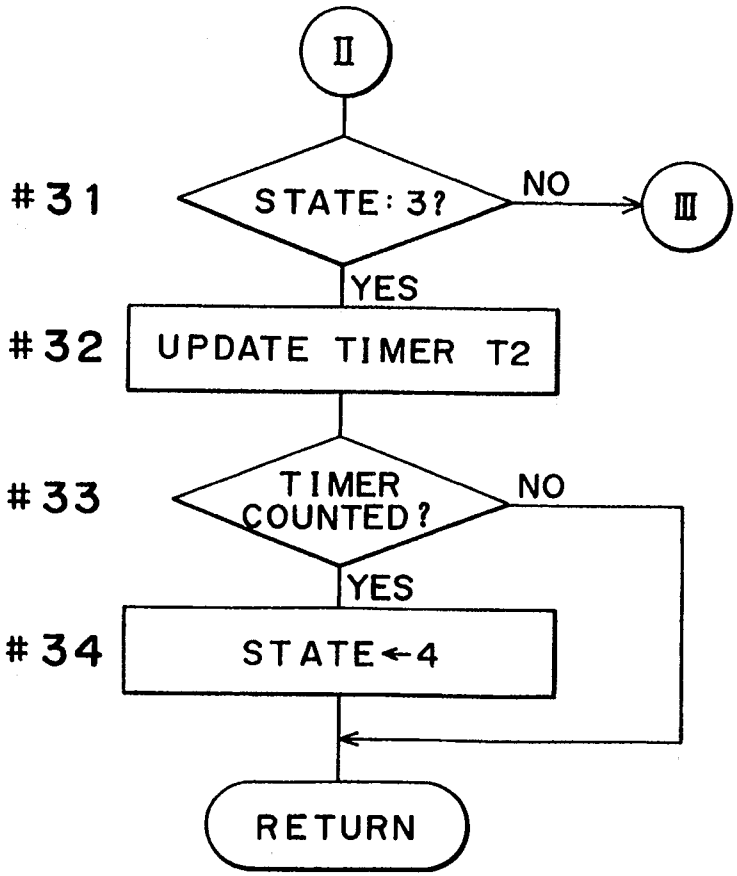

(3) In a process shown in FIG. 13, it is judged whether or not the state number is "3" at step #31, and in the case of "NO", step #41 follows, while in the case of "YES", the count number in the timer T2 is updated.

Next, it is judged whether or not the counting in the timer T2 has finished, and in the case of "NO", the program flow returns to the main routine, while in the case of "YES", the state number is set to "4" at step #34, thereafter it returns to the main routine.

Figure 14:
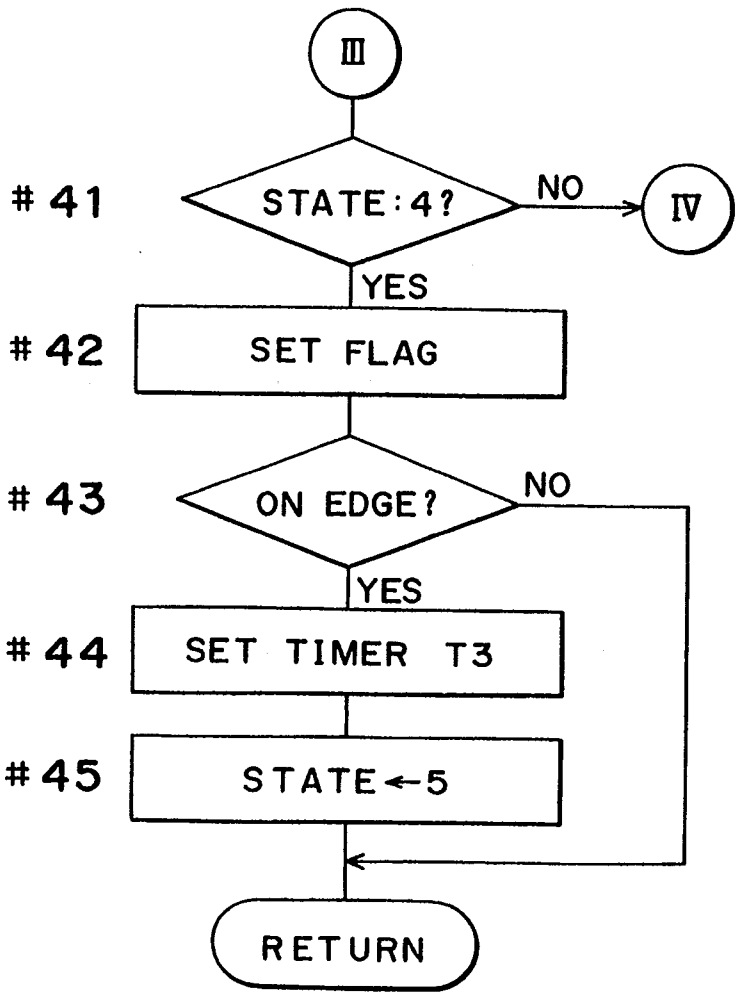

(4) In a process shown in FIG. 14, it is judged whether or not the state number is "4", and in the case of "NO", step #51 follows, while in the case of "YES", a flag for permitting to measure the toner density is set at step #42. Next, it is judged whether or not ON edge is detected, and in the case of "YES", step #44 follows, while in the case of "NO", the program flow returns to the main routine. The ON edge is detected in the case that an output from the photo-interrupter 40 varies from ON state to OFF state or from OFF state to ON state by interrupting light in the photo-interrupter 40 by the detection plate 39 on the conveying screw 37.

At step #44, a timer T3 is set, and at step #45, the state number is set to "5", thereafter the program flow returns to the main routine.

This timer T3 defines a time period required for the detection magnet 44 to reach a detection position of the sensor 50 after the detection plate 39 is detected at step #43.

Thus, only data obtained when the detection magnet 46 faces to the detection window 54 can be extracted by this timer T3.

Figure 15:
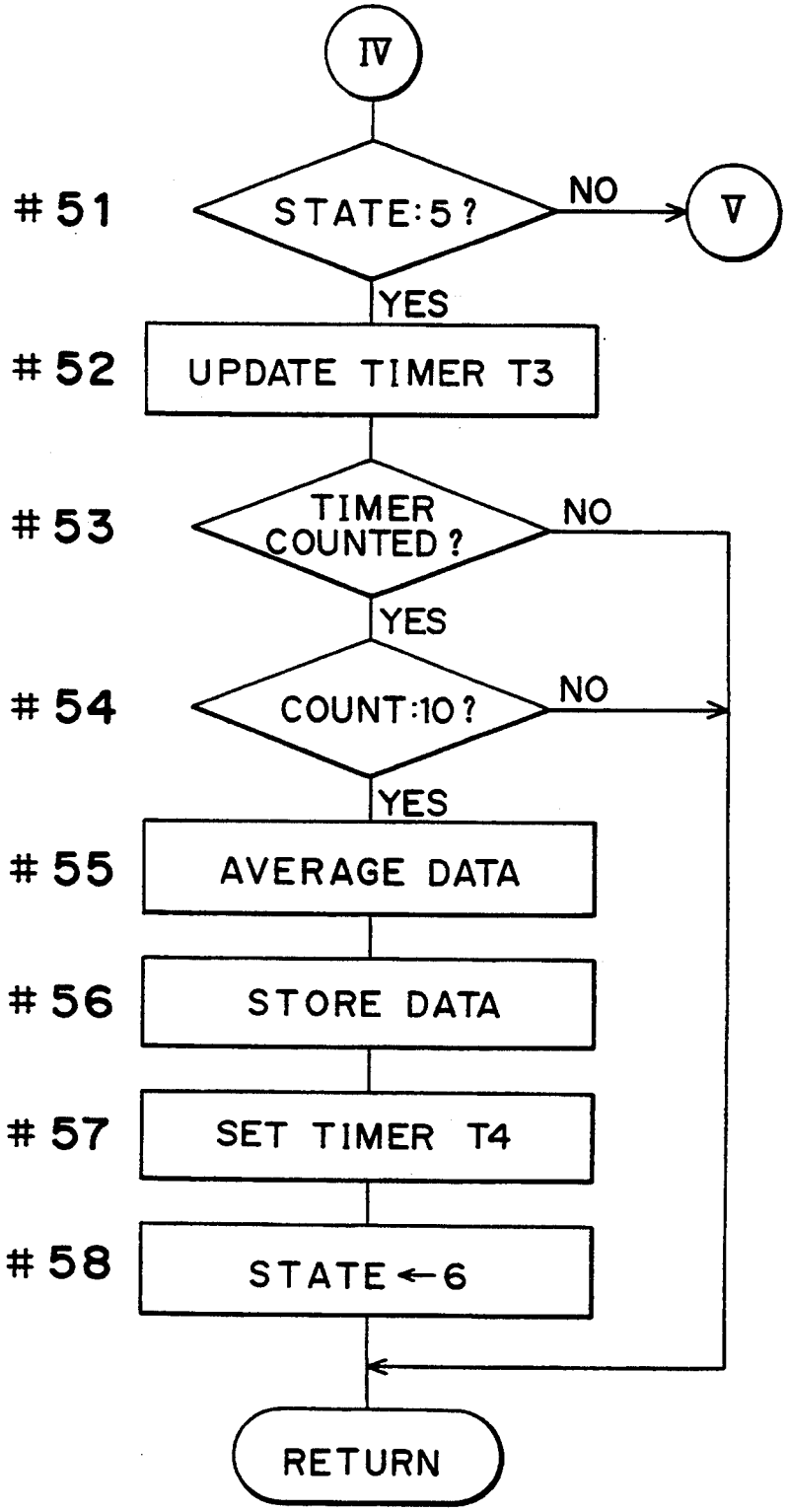

(5) In a process shown in FIG. 15, at step #51, it is judged whether or not the state number is "5", and in the case of "NO", step #61 follows, while in the case of "YES",step #52 follows. At step #52, a count number in the timer T3 is updated.

At step #53, it is judged whether or not counting in the timer T3 has finished, and in the case of "NO", the program flow returns to the main routine, while in the case of "YES", step #54 follows.

As shown in FIG. 9, sampling from output data X1, . . . from the sensor 50 is executed, and it is judged whether or not a number of the sampling data attains to ten, for example, at step #54, and in the case of "NO", namely the in the case that the sampling has not finished, the program flow returns to the main routine, while in the case of "YES", step #55 follows. At step #55, the above ten output data X1 to X10 are averaged (hereinafter, averaged value is referred to as "Xa"). In this manner, as a consequence of reading ten data, accidental data can be rounded.

Subsequently, at step #56, the above averaged output data Xa on the toner density measurement is stored in RAM of the CPU.

Furthermore, at step #57, a timer T4 for admitting to measure the toner density is set, and at step #58, the state number is set to "6", thereafter the program flow returns to the main routine.

A time set in the timer T4 corresponds to a time period required for the density measurement magnet 46 to recede completely from a portion facing to the detection window 54 after the sampling of the above data on the toner density has finished.

Meanwhile, the above sampled output data X1 to X10 are data obtained when the density measurement magnet 46 faces to the sensor 50. Namely, the output data are obtained from the developer present in the gap of a predetermined distance between the density measurement magnet 46 and the sensor 50.

Accordingly, as shown in FIG. 9, the output from the sensor 50 obtained during a period of the toner density measurement is stable, and in consequence, the obtained data are correct corresponding to the toner density. Further, in advance of the toner density measurement, the surface of the film 55 is cleaned by the magnetic brush 47 retained on the cleaning magnet 45, the toner adhering there are removed, and thus the output data reflect real toner density.

Figure 16:
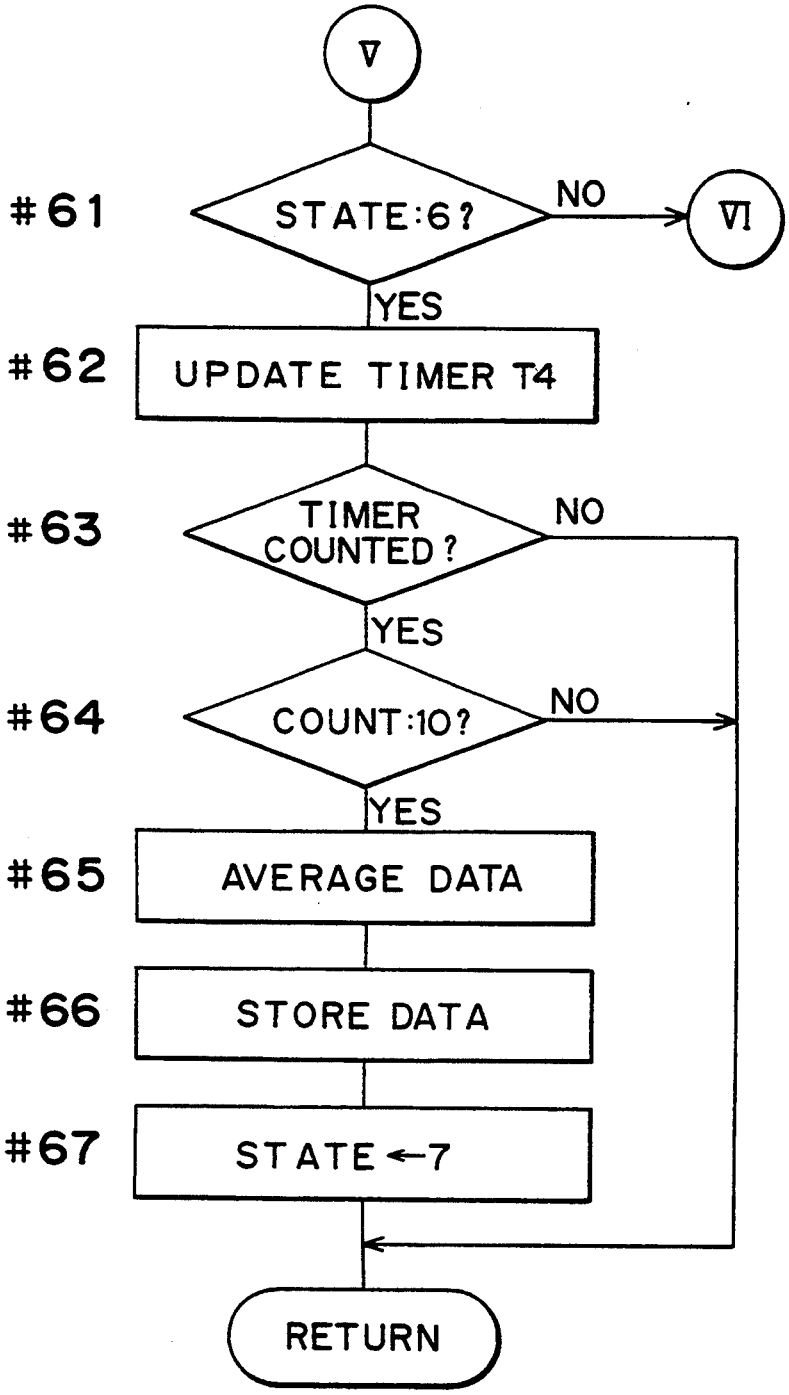

(6) In a process shown in FIG. 16, at step #61, it is judged whether or not the state number is "6", and in the case of "NO", step #71 follows, while in the case of "YES" step #62 follows.

At step #62, a count number in a timer T4 is updated.

At step #63, it is judged whether or not counting has finished, and in the case of "NO", the program flow returns to the main routine, while in the case of "YES", step #64 follows. Meanwhile, when the counting in the timer T4 has finished, either of magnetic pole 43, 44 recedes from a portion facing to the sensor 50.

When the counting in the timer T4 has finished, as shown in FIG. 9, sampling from output data Y1, . . . is execute, and at step #64, it is judged whether or not a number of the sampling data attains to ten, for example, and in the case of "NO", the program flow returns to the main routine, while in the case of "YES" step #65 follows.

At step #65, the above sampled ten data Y1 to Y10 are averaged (hereinafter, averaged data is referred to as "Ya"). At step #66, the averaged data Ya is stored in the RAM, and at step #67, the state number is set to "7", thereafter the program flow returns to the main routine.

Figure 17:
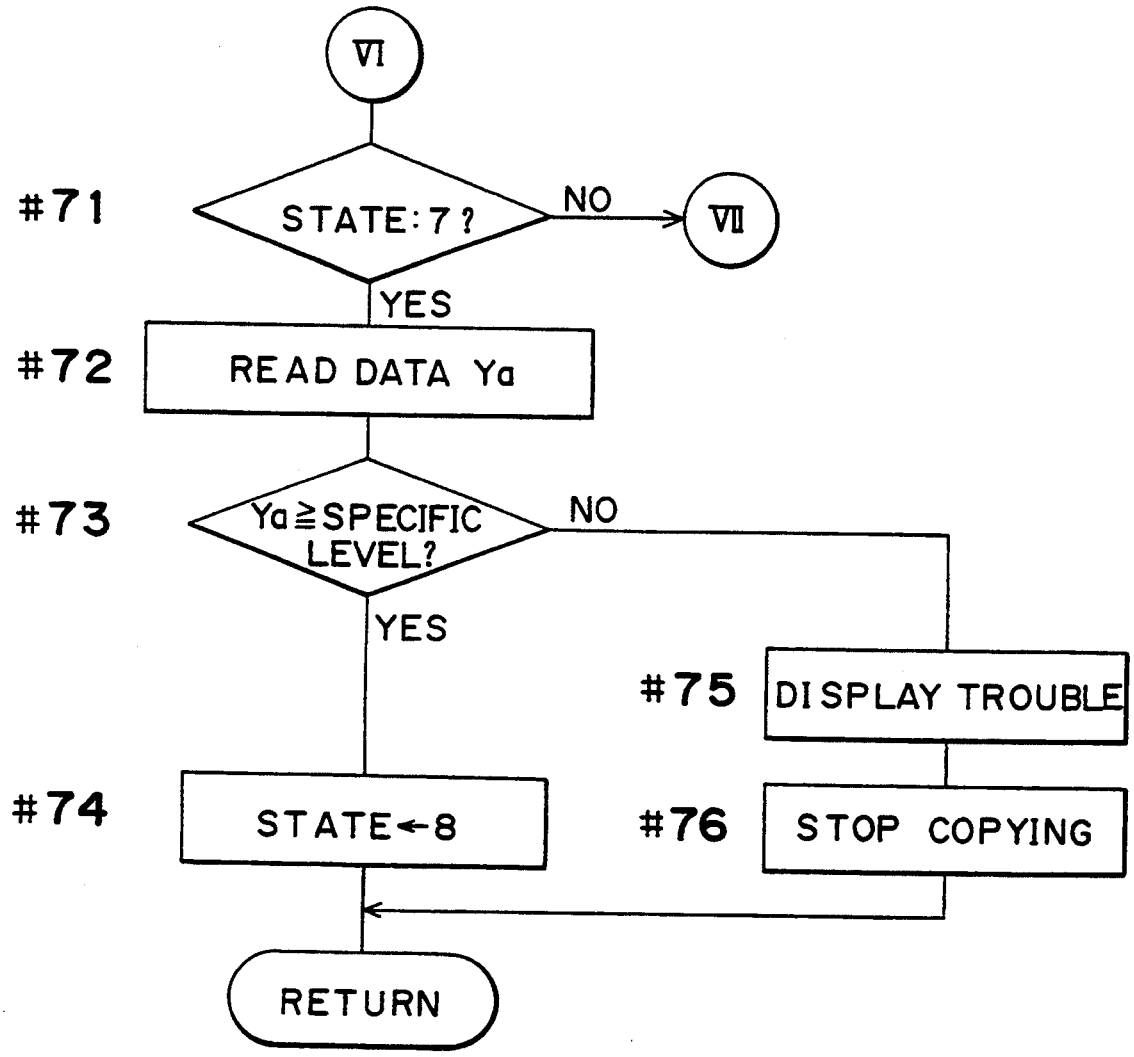

(7) In a process shown in FIG. 17, at step #71, it is judged whether or not the state number "7", and in the case of "NO", step #81 follows, while in the case of "YES" step #72 follows.

At step #72, the data Ya of amount of the developer, which is stored in the RAM, is read out. At step #73, it is judged based on the data Ya whether or not the amount of the developer(i.e., the data Ya) is of a predetermined level or more.

In the case of "YES" at step #73, step #74 follows, and the state number is set to "8", thereafter the program flow returns to the main routine.

On the contrary, in the case of "NO" at step #73, at step #75, a trouble display indicating occurrence of abnormality is performed on an operation panel(not shown), and at step #76, copying operation is stopped so as to prevent an inferior toner image to be formed, thereafter the program flow returns to the main routine.

Meanwhile, the predetermined level of the developer in step #73, on the basis of which the judgement is performed, means a level at which no developer exists in front of the detection window 54, and the output Ya from the sensor 50 varies abruptly.

Figure 18:
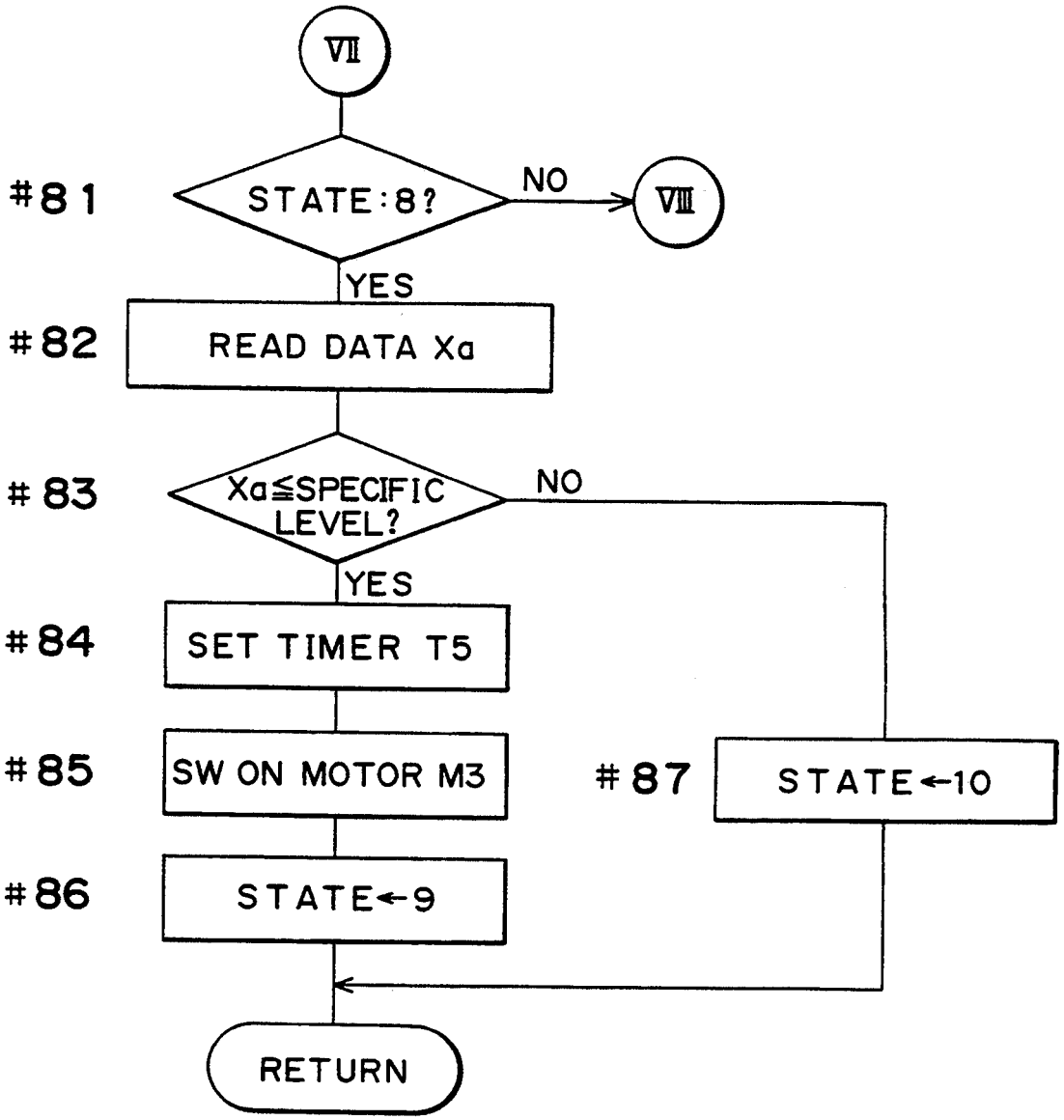

(8) In a process shown in FIG. 18, at step #81, it is judged whether or not the state number is "8", and in the case of "NO", step #91 follows, while in the case of "YES" step #82 follows.

At step #82, the density data Xa, which is stored in the RAM, is read out. Further, at step #83, it is judged whether or not the toner density (i.e., data Xa) of the developer is of a predetermined level or less, and in the case of "YES" step #84 follows. At step #84, a timer T5 for replenishing the toner is set, and at step #85, the toner replenishment motor M3 is driven so as to replenish the toner, which is supplied from the toner hopper 15, to the second agitator passage 32, and at step #86, the state number is set to "9", thereafter the program flow returns to the main routine.

On the contrary, in the case of "NO" at step #83, step #83 follows.

At step #87, the state number is set to "10", thereafter the program flow returns to the main routine.

Figure 19:
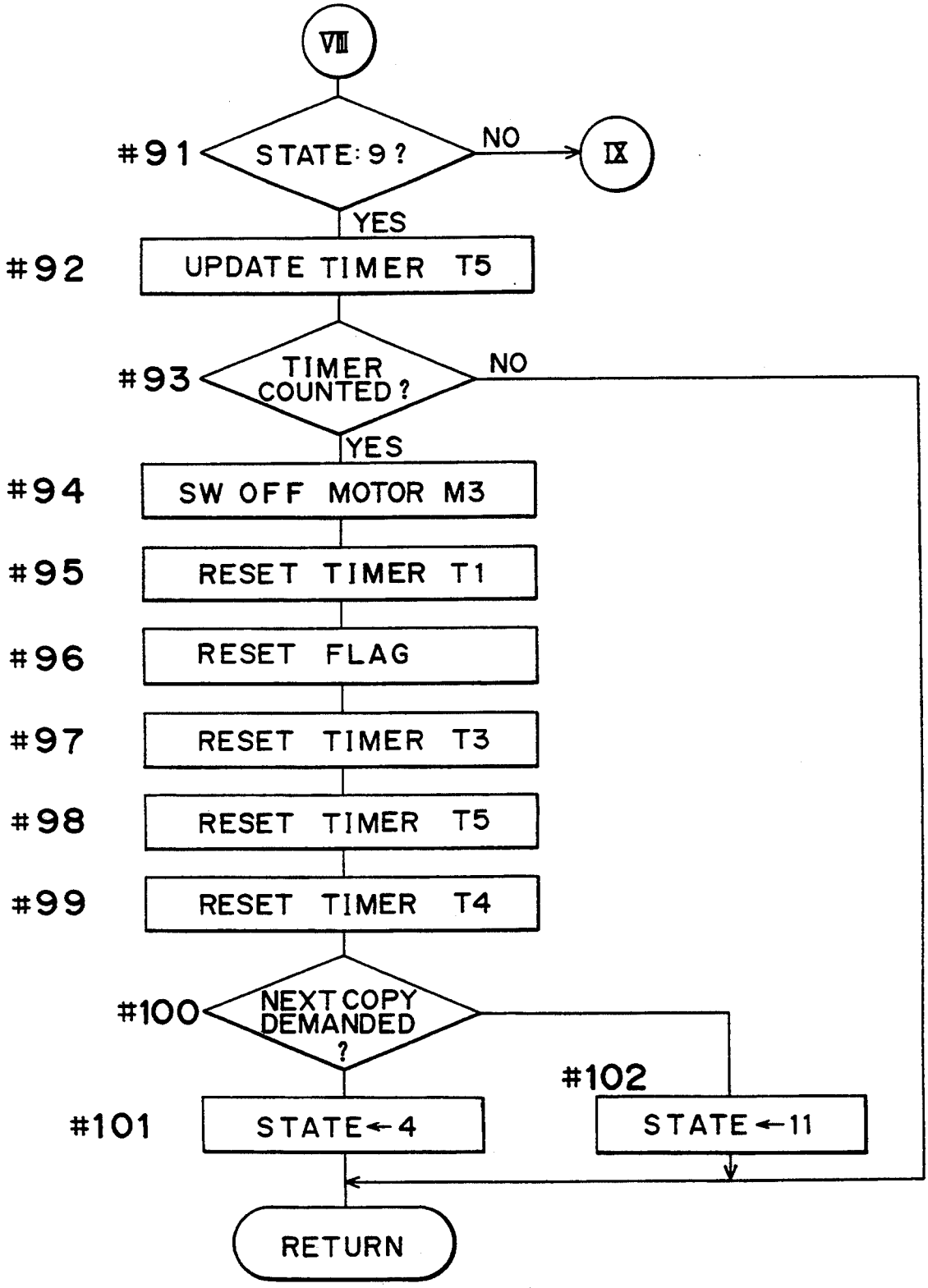

(9) In a process shown in FIG. 19, at step #91, it is judged whether or not the state number is "9", and in the case of "NO", step #111 follows.

On the other hand, in the case of "YES" at step #91, step #92 follows.

At step #92, a count number in the timer T5 is updated.

At step #93, it is judged whether or not a counting in the timer T5 has finished, and in the case of "NO", the program flow returns to the main routine, while in the case of "YES", step #94 follows.

At step #94, the toner replenishment motor M3 is switched off. Furthermore, at step #95 to #99, each of the timer T1, T2, T3, T4, T5 is reset.

Subsequently, at step #100, it is judged whether or not next copy is demanded, and in the case of "YES", step #101 follows.

At step #101, the state number is set to "4", thereafter the same operations mentioned above are repeated.

On the other hand, in the case of "NO" at step #100, step #102 follows,

At step #102, the state number is set to "11", thereafter the program flow returns to the main routine.

Figure 20:
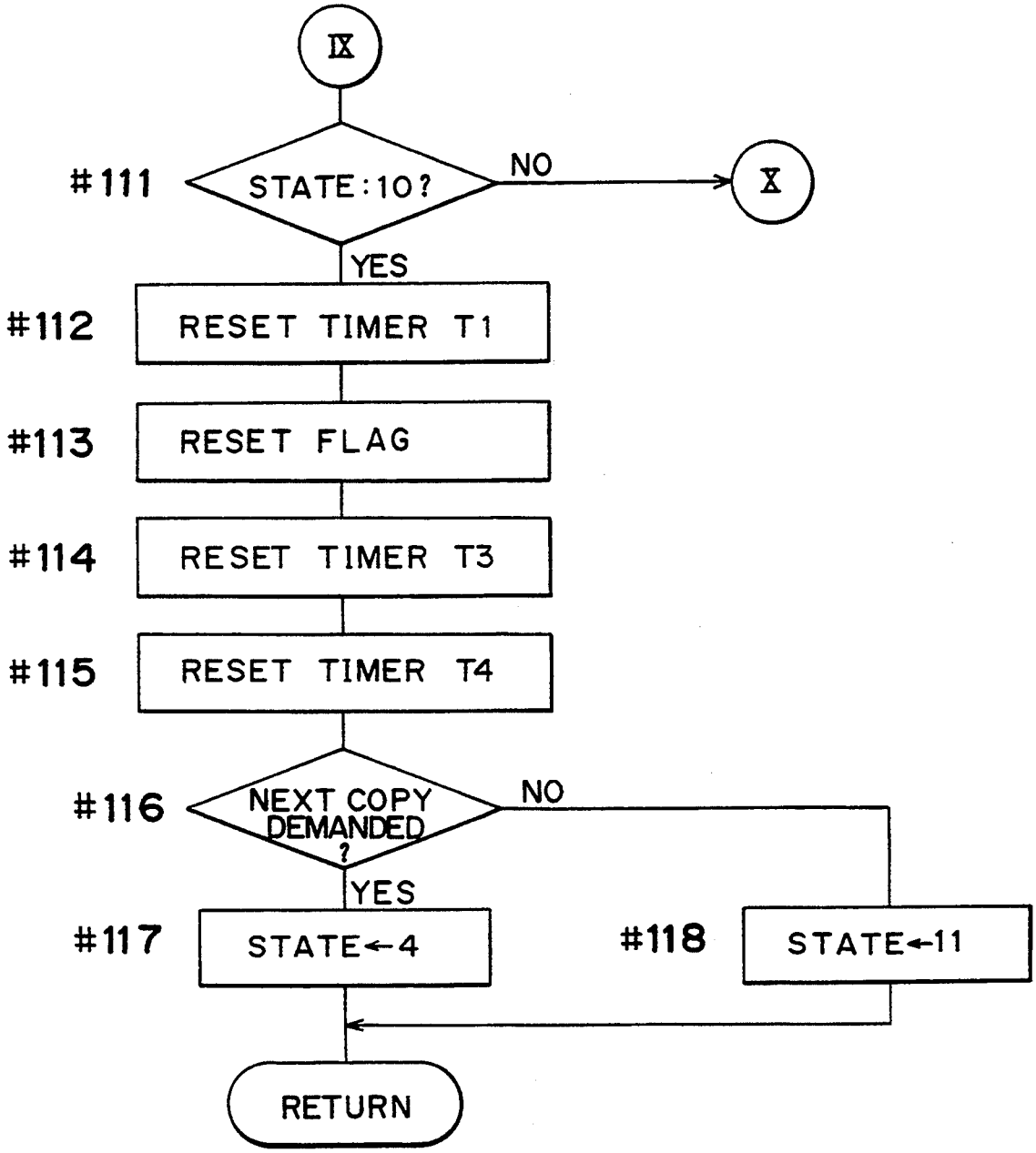

(10) In a process shown in FIG. 20, at step #111, it is judged whether or not the state number is "10", and in the case of "NO", step 121# follows.

On the other hand, in the case of "YES" at step #100, namely when the toner density is of a predetermined level or more, step #112 follows. At steps #112 to #115 each timer T1, the flag for permitting to measure the toner density, timers T3 and T4 are reset, respectively.

Further, at step #116, it is judged whether or not next copy is demanded, and in the case of "YES", step #117 follows. At step #117, the state number is set to "4", thereafter above described operation is repeated. While in the case of "NO" at step #116, step #118 follows. At step #118, the state number is set to "11".

Figure 21:
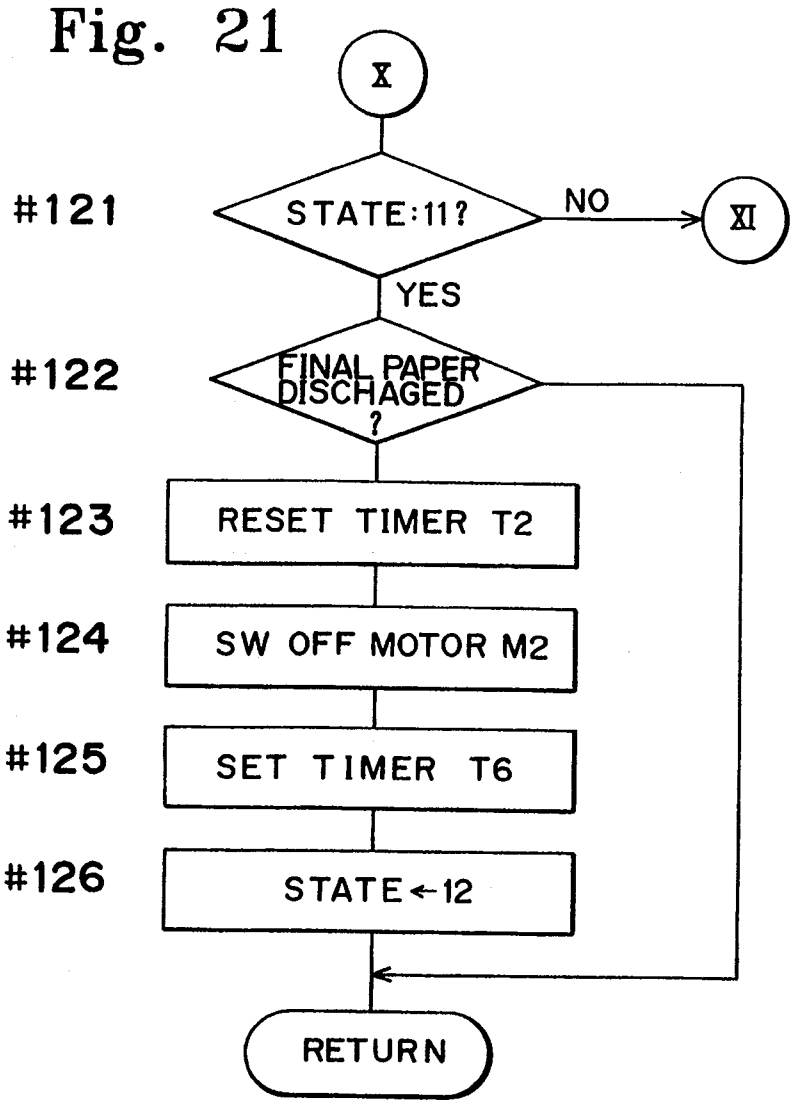

(11) In a process shown in FIG. 21, at step #121, it is judged whether or not the state number is "11", and in the case of "NO", step #131 follows, while in the case of "YES", step #122 follows.

At step #122, it is judged whether or not final transfer paper has passed through the fixing apparatus 13, and has been discharged to the discharge tray 14. This judgement is executed on the basis of a signal output from the detection switch 16 provided in the transporting passage extending from the fixing apparatus 13 to the discharge tray 15.

In the case of "NO", the program flow returns to the main routine, while in the case of "YES" at step #122, step #123 follows. At step #123, the timer T2 is reset, and at step #124, the agitator motor M2 is switched off, and at step #125, the timer T6 is set, and at step #126, the state number is set to "12", thereafter the program flow returns to the main routine (See FIG. 8).

Figure 22:
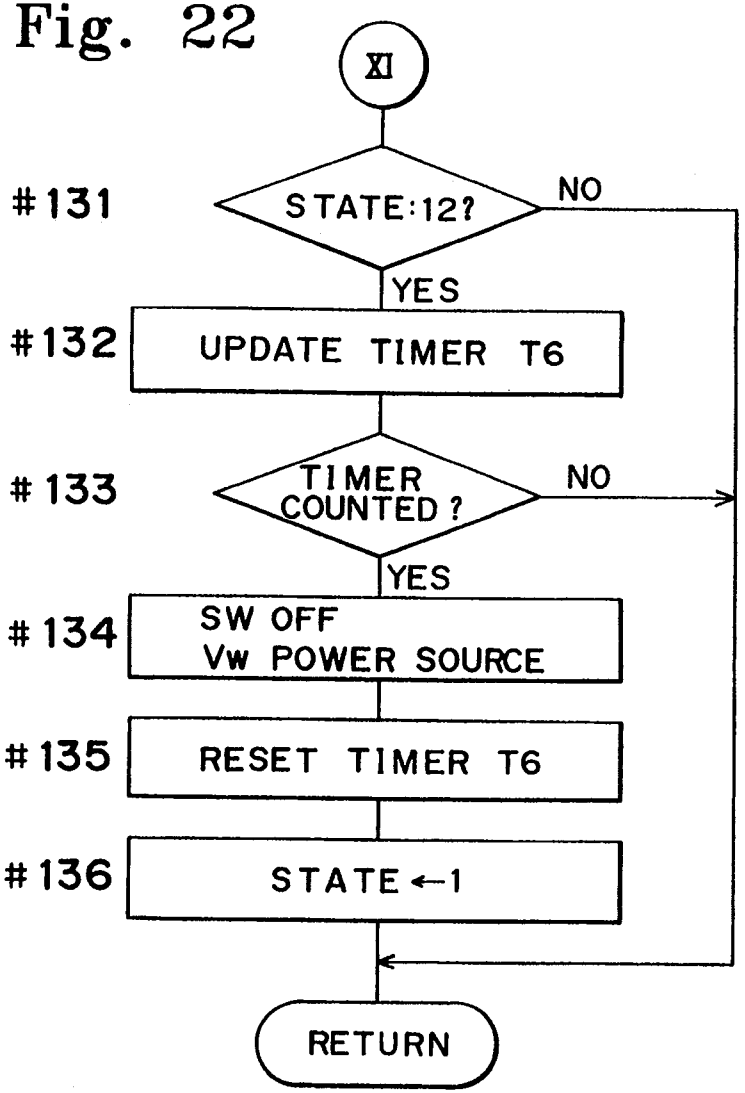

(12) In a process shown in FIG. 22, at step #131, it is judged whether or not the state number is "12" and in the case of "NO", the program flow returns to the main routine, while in the case of "YES", step #132 follows. At step #132, the count number in the timer T6 is updated.

Next, at step #133, it is judged whether or not the counting in the timer T6 has finished, and in the case of "NO", the program flow returns to the main routine, while in the case of "YES", step #134 follows. At step #134 the electric power source 58 is switched off. At step #135, the timer T6 is reset, and at step #136, the state number is set to "0", thereafter the program flow returns to the main routine.

In this manner, as shown in FIG. 8, the electric power source 58 is switched off when a time period counted by the timer T6 has elapsed after the agitator motor M2 has been stopped. Namely, since the window bias $V_W$ is cut off in a condition in which a movement of the developer in the second agitator passage 32 is stopped, the adhering of the developer onto the detection window 54 is prevented. Therefore, when the window bias $V_W$ is applied to the film 55 after the development apparatus 8Y is driven succeedingly, the toner density detection is performed again under a condition, in which the developer does not adhere onto the detection window 54.

As will be apparent from the description given so far, in an apparatus for measuring developer density of the invention, the developer retained on the magnets is rubbed against the detection window, and the developer density is measured by illuminating the developer rubbed against the window, in the developer agitator section.

Namely, the developer density is measured from the developer having constant thickness and retained in a space between the magnets and the detection window.

Accordingly, even if amount of the developer contained in the developer agitator section, and condition of the developer vary, an output of the sensor is stable, and thus correct density can be measured.

Further, in a multi-color image forming apparatus which has a plurality of the development apparatuses contain the developers of different colors, respectively, such that the development apparatuses face to the photosensitive drum alternatively, even the developer density in a development apparatus in a non-development period can be measured. Therefore, the development apparatus in non-development period can be set to development period at a proper level of the developer density.

Accordingly, it becomes possible to alternate the development apparatus quickly, and thus to gain full-color image having proper density in a short time.

Figure 23:
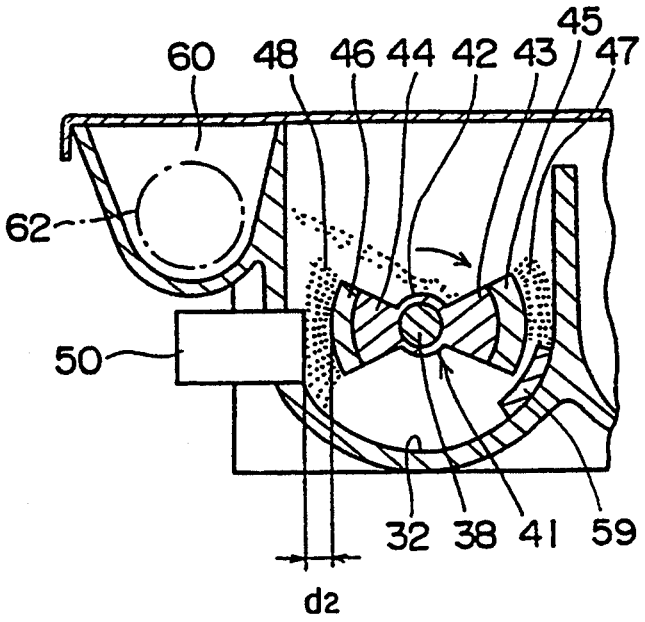
FIGS. 23 and 24 is a sectional view showing a part of a development apparatus showing a second embodiment of the present invention.
Figure 24:
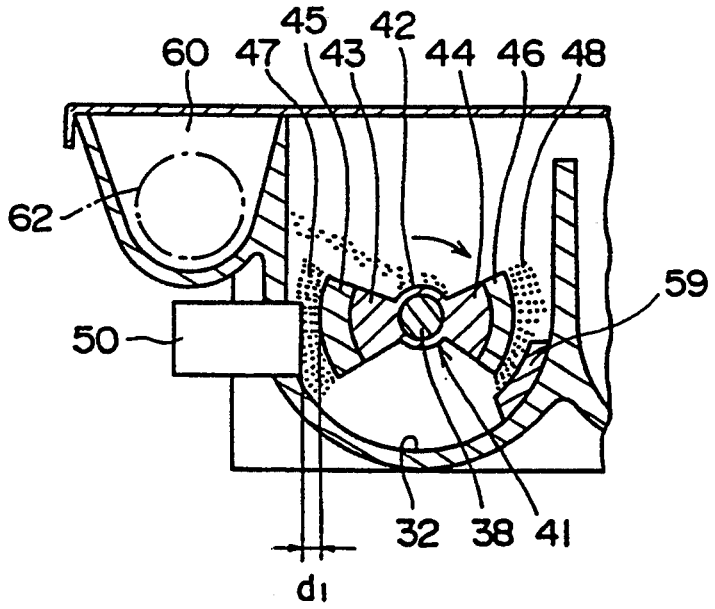

FIGS. 23 and 24 show a part of a development apparatus for measuring developer density according to a second embodiment of the invention.

In this embodiment, a distance between a center of the shaft 38 and a peripheral surface of the magnet 45 is longer than a distance between the center and a peripheral surface of the magnet 46. Thus, gaps d1 and d2 between the peripheral surfaces of the magnets 45, 46 and the detection window 54 of the sensor 50 is set to be $d1<d2$.

Figure 25:
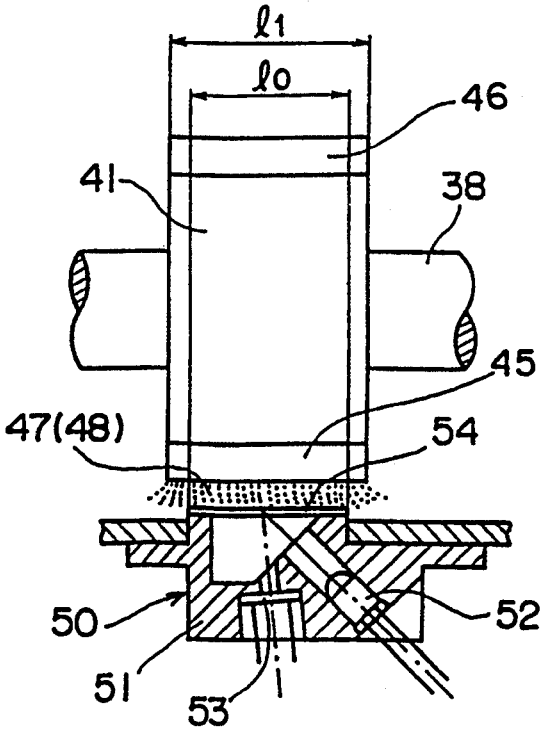
FIG. 25 is a sectional view showing relation between a sensor for measuring toner density and magnets of the second embodiment of the present invention.

In addition, as shown in FIG. 25, a width $l_1$ in a direction perpendicular to moving direction of the magnets 45, 46 is wider than a width $l_0$ of the detection window 54 of the sensor 50.

Figure 26:
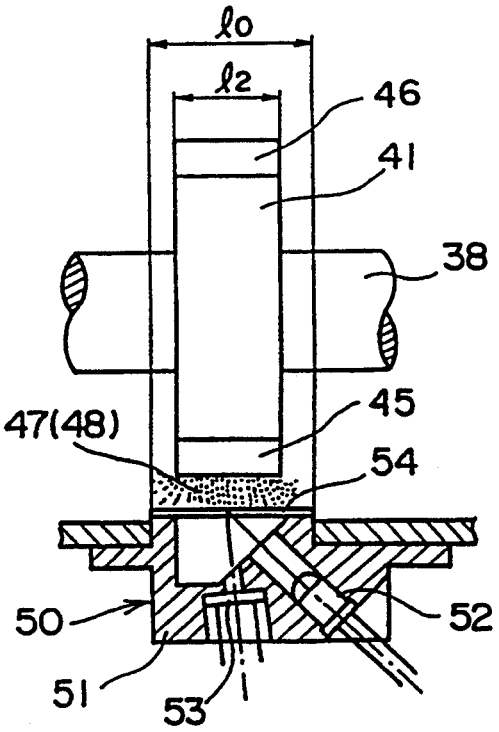
FIG. 26 is a sectional view similar to FIG. 25, particularly showing its comparative example.

As shown in FIGS. 2 and 3, the sensor 50 is mounted on the rear wall portion of the second agitator passage 32 so as to pass through the rear wall portion facing the region in which the magnets 45, 46 pass such that the sensor 50 is situated at inside of the width $l_1$ of the magnets 45, 46. As shown in FIG. 25, since the width $l_1$ of the magnets 45, 46 in a longitudinal direction of the shaft 38 is wider than the width $l_0$ of the detection window 54, and the detection window 54 is situated at the inside of the width $l_1$, magnetic brush rising from the outer periphery of the magnets 45, 46 is brought into contact with the detection window 54, and thus whole of the detection window 54 is cleaned uniformly. Meanwhile, as shown in FIG. 26, contrary to this embodiment, in the case that the width $l_0$ of the detection window 54 is wider than a width $l_2$ of the magnets 45, 46, it is impossible to clean the whole of the detection window 54 uniformly, and thus the developer adheres onto the detection window 54.

Figure 27:
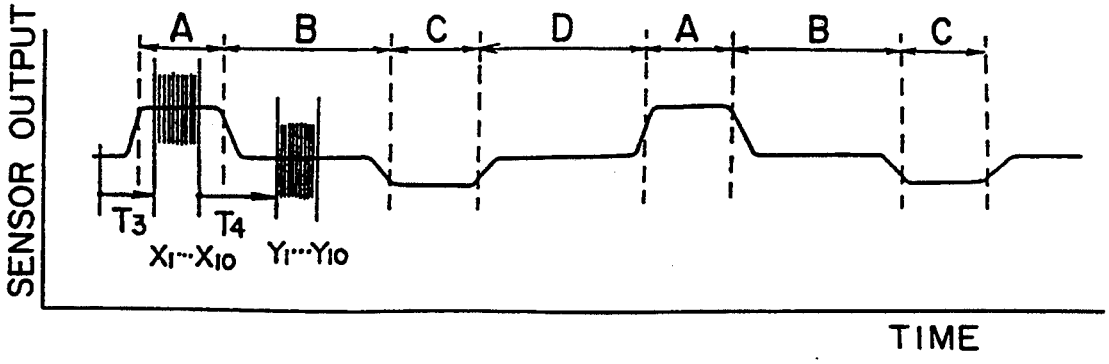
FIGS. 27 and 28 are graph showing relation between an output from a sensor for measuring the toner density and time in each of the second and third embodiments of the present invention.

Further, since the gaps between the magnets 46, 47 and the detection window 54 is set to constant value d1, d2, respectively, and amount of the developer existing in a space between them is kept stable by magnetic forces of the magnets 45, 46 when the magnets 46, 47 face to the sensor 50, an output from the sensor 50, as shown in regions A, C, respectively, in FIG. 27, corresponds to the toner density, and does not vary with a variation of amount or bulk density of developer contained in the second agitator passage 32.

Meanwhile, an output (i.e., output in a region A) in the case that the magnet 46 faces the sensor 50 is larger than an output (i.e., output in a region B) in the case that the magnet 45 faces the sensor 50, because the gaps between the magnets 45, 46 and sensor 50 is set to be $d1<d2$, and thus each density of the magnetic brush coming into contact with the detection window 54 is different.

Figure 30:
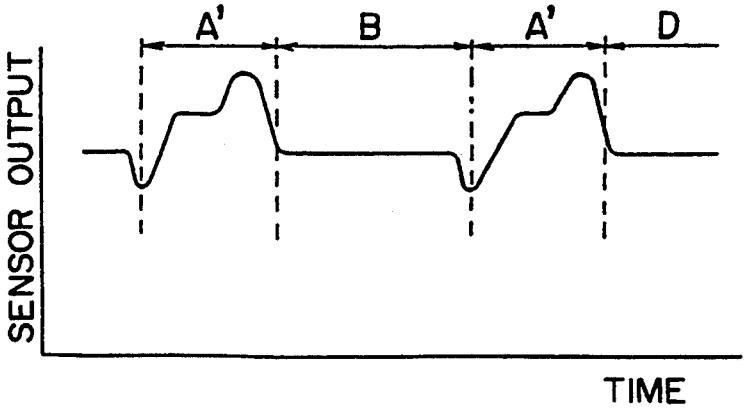
FIG. 30 is a graph showing relation between an output from a sensor for measuring the toner density in FIG. 29 and time.
Figure 29:
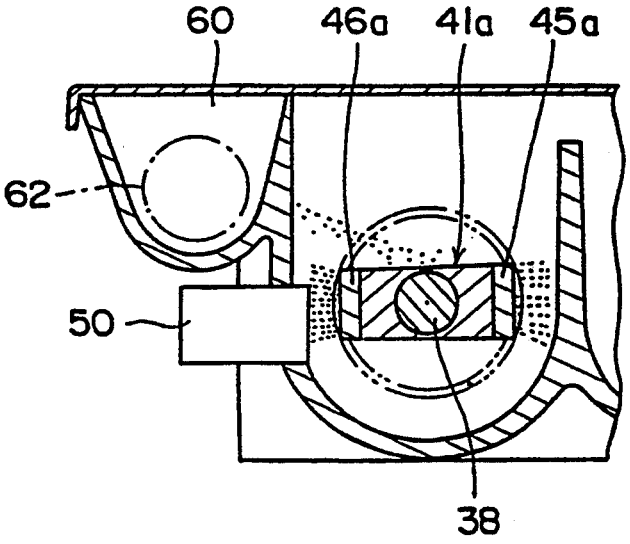
FIG. 29 is a sectional view similar to FIG. 23, particularly showing its comparative example.

In addition, when the magnets 45, 46 face the sensor 50, the output is stable, because the outer peripheral of the magnets 45, 46 lie on a circle coaxial with the shaft 38. For example, as shown in FIG. 29, in the case that magnets **45*a*, 46*a* having a rectangular cross-section are mounted on a retainer 41*a*, as shown in a region A' in FIG. 30, a ripple occurs in an output from the sensor 50 when the magnets 45*a*, 46*a* is approaching the sensor 50**, and receding from it.

On the other hand, when the magnets 45, 46 do not face the sensor 50, the output from the sensor 50 (i.e., output in a region B in FIG. 27) varies with amount of the developer in the second agitator passage 32.

Based on the above described phenomena, the toner density is measured from the signal (i.e., signal in a region A in FIG. 27) output from the light receiving element 53 when the magnetic brush 48 of the magnet 46 is rubbed against the detection window 54.

While, the amount of the developer is measured from the signal (i.e., signal in a region B in FIG. 27) output from the light receiving element 53 when the magnetic brushes 47, 48 are not in contact with the detection window 54.

Such processes of the measurement of the toner density and the amount of the developer are executed not only in a development apparatus in development state facing the photosensitive drum 2, but also in development apparatus in non-development state being away from the photosensitive drum 2.

Namely, in development apparatus in non-development state, the toner density etc., are measured by suitably driving the agitating motor 38, and thus each of these apparatuses has already been set in a conditions of proper toner density and the amount of the developer, when each of them is set in development state.

Figure 28:
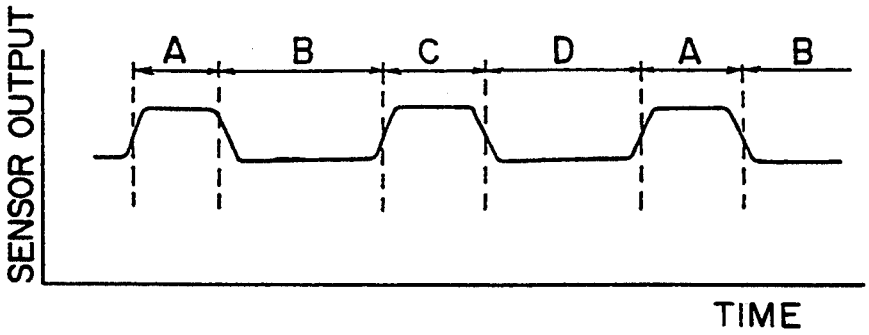

Meanwhile, in the above described embodiment, the magnet 45 and the magnet 46 are distinguished by varying a distances from outer surfaces of the magnets 45 and 46 to the center of the shaft 38 from each other. However, in a third embodiment according to the present invention, the magnets 45 and 46 is distinguished by making the gaps identical, and making their magnetic forces different from each other. In this case, the magnetic force of the magnet 45 is set to 2000 gauss, and the magnetic force of magnet 46 is set to 1000 gauss, for example. In this manner, by making the magnetic forces different from each other, retaining force for retaining magnetic brush on the magnet 45 becomes stronger than retaining force for retaining magnetic brush on the magnet 46, so that a developer adhering on the detection window 54 can be easily removed. However, as shown in FIG. 28, signals output from the sensor 50 (each corresponding to regions A and C) become to same level when the magnets 45 and 46 face sensor 50.

Further, the detection window 54 may be made in a form of arc so as to be maintained uniform gap between the detection window 54 and a surface of each of the magnets 45 and 46. In this case, good cleaning effect is obtained throughout the detection window 54, and stable output from sensor 50 is obtained.

Further, each of opposite edges of the magnets 45 and 46 in the direction of their rotation may be made in a form of a curved surface by cutting their edges. In this manner, concentration of lines of magnetic force is reduced. Further, stress on the detection window 54 subjected from the developer is reduced.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. Apparatus for detecting magnetic developer comprising:

an electrostatic latent image carrier;

a developing member for supplying the developer to the image carrier;

magnetic means, fixed in the developing member, for forming magnetic brush onto the developing member;

a developer agitating section accommodating developer and supplying the developer to the developing member;

a rotation agitating member provided in the developer agitating section for agitating the developer in accordance with its rotation prior to said developer being supplied from said developer agitating section to said developing member;

a detection window facing said developer agitating section in the vicinity of said rotational agitating member;

a cleaning magnet portion having at least a pair of magnets and being fixed on said rotational agitating member for causing developer to be brought into contact with said detection window with a rotation of said rotational agitating member and for scraping off developer from the surface of the window, the distance between one of the magnets and the detection window being set so as to be smaller than a distance between the other magnets; and detecting means for detecting the developer accommodated in the developer agitating section by monitoring the developer agitation section through the window.

2. Apparatus for detecting magnetic developer comprising:

an electrostatic latent image carrier;

a developing member for supplying the developer to the image carrier;

a developer agitating section accommodating developer and supplying the developer to the developing member;

a rotational agitating member provided in the agitating section for agitating the developer in accordance with its rotation;

a detection window facing said developer agitating section;

a cleaning magnet portion having a plurality of magnets and being fixed on said rotational agitating member for causing said developer to be brought into contact with said detection window with a rotation of said rotational agitating member to scrape off the developer from the surface of the window, the cleaning magnet portion having at least a pair of magnets and one of the magnets is stronger than the other in magnetic force; and detecting means for detecting the developer accommodated in agitating section by monitoring the agitation section through the window.

3. Apparatus for detecting developer accommodated in an agitator section comprising:

a detection window facing the agitator section;

an agitator means agitating said developer accommodated in said agitator section;

drive means driving said agitator means;

an electric power source applying to said detection window a voltage having a polarity identical with a polarity of said charged toner;

means for detecting the developer accommodated in the agitator section through the window; and controlling means for controlling the drive means and said power source so that the power source is turned on to apply the voltage to the window before the drive means is turned on to drive said agitator means to agitate the developer.

4. Apparatus as claimed in claim 3, wherein the controlling means further controls the drive means and the power source so that the power source is turned off to stop applying the voltage to the window after the drive means is turned off to stop driving the agitator means to agitate the developer.

5. Apparatus for measuring developer density comprising:

a container section containing a developer constituted by a toner and a carrier;

a rotary member agitating said developer in said container section with its rotation;

a measuring section including a detection means detecting a relation between a position of said rotary member and that of the measuring section, said measuring section measuring said developer density in said container section through a detection window facing the container section;

a magnet member being supported on said rotary member so as to be rotated with a rotation of said rotary member, and retaining said developer so as to cause said developer to be brought into contact with said detection window;

a measuring means measuring developer density at said measuring section when said magnet member rotating with said rotary member is situated facing said measuring section, said detection means being connected with said rotary member and detecting a rotary position of said rotary member.

6. Apparatus as claimed in claim 5 wherein a scraper is provided upstream of said measuring section in a direction of a rotation of said rotary member such that a gap between said scraper and said magnet member is maintained at a predetermined value.

7. Apparatus as claimed in claim 6 wherein said scraper is made of non-magnetic material.

8. Apparatus as claimed in claim 5 wherein said container section comprises:

a first agitator passage facing a development roller and conveying developer in an axial direction of said development roller so as to supply developer to said development roller;

a second agitator passage facing a replenishment opening for replenishing said toner and circulating said developer through said first agitator passage so as to agitate and mix said developer; and said rotary member and said measuring section are provided in said second agitator passage.

9. Apparatus as claimed in claim 8 wherein said rotary member and said measuring section are situated in said second agitator passage between a passage for conveying said developer from said first passage to said second agitator passage and said replenishment opening.

10. Apparatus as claimed in claim 5 wherein said measuring section is provided on a side wall of said second agitator passage.

11. Apparatus as claimed in claim 5 wherein said measuring section is provided on a side wall of said container section.

12. Apparatus as claimed in claim 5 wherein said measuring section is provided such that it is embedded at nodal condition in said developer in said container section.

13. Apparatus as claimed in claim 5 wherein said rotary member is a conveying screw.

14. Apparatus as claimed in claim 5 wherein said detection window is subjected to a treatment for making said detection window electrically conductive, and window bias having a polarity identical with that of toner is applied to said detection window.

15. Apparatus as claimed in claim 14 wherein said window bias is applied before driving said rotary member.

16. Apparatus as claimed in claim 14 wherein said window bias is applied after stopping driving of said rotary member.

17. Apparatus as claimed in claim 16 wherein said window bias is applied before driving said rotary member.

18. Apparatus as claimed in claim 14 wherein a groove is formed along a periphery of said detection window portion, and said treatment is performed by applying adhesive to said detection window outwardly of the groove such that electrically conductive film is bonded to said detection window.

19. Apparatus as claimed in claim 5 wherein said developer density is measured a plurality of times by said measuring section when said measuring section is detected by said detection means to be facing said magnet member, and an averaged value of said measured developer density is used for controlling developer replenishment.

20. Apparatus as claimed in claim 5 wherein a surface of said magnet member facing said measuring section is made in a form of an arc.

21. Apparatus as claimed in claim 5 wherein said detection means is a photo-interrupter.

22. Apparatus as claimed in claim 5 wherein said magnet member includes a plurality of magnets at equal intervals on a peripheral surface of said rotary member.

23. Apparatus as claimed in claim 22 wherein a number of said magnets is two, and said two magnets are provided at opposite positions on said rotary member.

24. Apparatus as claimed in claim 22 wherein contact force of said developer retained by at least one of said magnets against said detection window is set stronger than those of the remaining magnets, and a value measured by said measuring section at the time when said one of said magnets faces said measuring section is not used for controlling developer density.

25. Apparatus as claimed in claim 24 wherein a difference between said contact force of said one of said magnets and each of those of said remaining magnets is set by making a gap between said one of said magnets and said measuring section different from that between each of the remaining magnets and said measuring section.

26. Apparatus as claimed in claim 24 wherein a difference between said contact force of said one of said magnets and each of those of said remaining magnets is set by making a magnetic force of said one of said magnets different from those of said remaining magnets.

27. Apparatus as claimed in claim 5 wherein said detection window has a concavely arcuate surface.

28. Apparatus as claimed in claim 5 wherein each of opposite edge portions of said magnet member in the direction of its rotation is made in a form of a curved surface.

29. Apparatus as claimed in claim 5 wherein a width of said magnet member is wider than that of said detection window.

30. Apparatus for measuring density of a developer constituted by a toner and a carrier by reflected light from said developer in a container section illuminated through a transparent detection window, said apparatus comprising:

an electrically conductive film for applying window bias to said detection window;

at least one slot formed on said detection window at a position spaced inwardly from an outer edge thereof; and an adhesive applied to said detection window outwardly of said at least one slot such that said electrically conductive film is bonded to said detection window between said at least one slot and said outer edge.

31. Apparatus for measuring developer density comprising:

a container section containing a developer constituted by a toner and a carrier;

a rotary member agitating said developer in said container section with its rotation;

drive means for driving said rotary member;

a measuring section measuring said developer density in said container section by reflected light from said developer illuminated through a detection window facing said measuring section;

a window bias applying means for applying window bias having a polarity identical with that of charged toner to said detection window; and control means for controlling said window bias applying means and said drive means so that said window bias applying means is turned on to apply said window bias to said detection window before said drive means is turned on to drive said rotary member.

32. Apparatus for measuring developer density comprising:

a container section containing a developer constituted by a toner and a carrier;

a rotary member agitating said developer in said container section with its rotation;

drive means for driving said rotary member;

a measuring section measuring said developer density in said container section by reflected light from said developer illuminated through a detection window facing said measuring section;

a window bias applying means for applying window bias having a polarity identical with that of charged toner to said detection window; and control means for controlling said window bias applying means and said drive means for stopping the application of said window bias to said detection window by said window bias applying means after stopping said drive means from driving said rotary member.

33. Apparatus as claimed in claim 32 wherein said control means also controls said window bias applying means and said drive means to turn on said window bias applying means to apply said window bias prior to turning on said drive means to drive said rotary member.

* * * * *

UNITED STATES PATENT AND TRADEMARK OFFICE

CERTIFICATE OF CORRECTION

PATENT NO. : 5,383,007

DATED : January 17, 1995

INVENTOR(S) : Naoyoshi Kinoshita, et al.

It is certified that error appears in the above-identified patent and that said Letters Patent is hereby corrected as shown below:

In col. 1, line 27, change "developed" to --developer--.

In col. 2, line 39, after "even" insert --if the-.

In col. 3, line 49, change "shown" to --shows--.

In col. 5, line 29, change "31" to --32--.

In col. 7, line 12, before "31" insert --passage--.

In col. 9, line 4, change "is" (second occurrence) to --its--.

In col. 15, line 54 (Claim 1, line 31), change "agitation" to --agitating--.

In col. 16, line 18 (Claim 3, line 6), before "driving" insert --for--.

In col. 17, line 25 (Claim 12, line 3), change "nodal" to --normal--.

Signed and Sealed this

Twenty-sixth Day of September, 1995

*Attest:*

Bruce Lehman

BRUCE LEHMAN

*Attesting Officer*

*Commissioner of Patents and Trademarks*